US011840915B2

(12) United States Patent
Ali

(10) Patent No.: US 11,840,915 B2
(45) Date of Patent: Dec. 12, 2023

(54) MODELING ACID FLOW IN A FORMATION

(71) Applicant: Baker Hughes Oilfield Operations LLC, Houston, TX (US)

(72) Inventor: Mahmoud Ali, Sugarland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/980,800

(22) Filed: Nov. 4, 2022

(65) Prior Publication Data

US 2023/0235656 A1 Jul. 27, 2023

Related U.S. Application Data

(60) Provisional application No. 63/301,922, filed on Jan. 21, 2022.

(51) Int. Cl.
*E21B 43/27* (2006.01)

(52) U.S. Cl.
CPC ..... *E21B 43/27* (2020.05); *E21B 2200/20* (2020.05)

(58) Field of Classification Search
CPC ..... E21B 43/27; E21B 2200/20
See application file for complete search history.

(56) References Cited

U.S. PATENT DOCUMENTS 6,196,318 B1 3/2001 Gong et al.
9,938,800 B2 4/2018 Karale et al.
10,480,314 B2 11/2019 Ziauddin et al.
10,774,638 B2 * 9/2020 Karale ..... C09K 8/72
2008/0015832 A1 1/2008 Tardy
2014/0212006 A1 7/2014 Zhao et al.
2015/0345267 A1 12/2015 Modavi et al.
(Continued)

FOREIGN PATENT DOCUMENTS

WO 2016164056 A1 10/2016
WO 2016195623 A1 12/2016
(Continued)

OTHER PUBLICATIONS

"Matrix Acid Stimulation Design and Analysis Software"; STIM2001; Stimulation Software; Halliburton; 2021; 1 Page.
(Continued)

*Primary Examiner* — Matthew R Buck
(74) *Attorney, Agent, or Firm* — CANTOR COLBURN LLP

(57) ABSTRACT

Examples described herein provide for modeling acid flow for acid stimulation of a formation. An example method includes receiving data about the acid stimulation. The method further includes modeling, by applying the data about the acid stimulation to a model, a wormhole velocity of an acid injected into the formation during the acid stimulation, wherein the wormhole velocity is a function of a Darcy velocity of the acid. The method further includes determining whether the wormhole velocity satisfies a wormhole velocity threshold. The method further includes, responsive to determining that the wormhole velocity fails to satisfy the wormhole velocity threshold, modifying a stimulation parameter to adjust the wormhole velocity of the acid. The method further includes performing the acid stimulation based at least in part on the modified stimulation parameter.

19 Claims, 29 Drawing Sheets

(56) References Cited

U.S. PATENT DOCUMENTS

2017/0107796 A1* 4/2017 Karale ..... E21B 41/0092
2020/0370430 A1 11/2020 Karale et al.

FOREIGN PATENT DOCUMENTS

WO 2018226772 A1 12/2018
WO 2020219629 A1 10/2020
WO WO-2020219629 A1 * 10/2020 ..... C09K 8/602

OTHER PUBLICATIONS

"Matrix Acidizing Design and Analysis Software"; StimPro; Product Information Sheet; FracPro; 2 Pages.
"Matrix Stimulation Design Software"; Kinetrix Matrix; Schlumberger; 2021; 1 Page.
Ali et al.; "Carbonate Acidizing: A Mechanistic Model for Wormhole Growth in Linear and Radial Flow"; Journal of Petroleum Science and Engineering; vol. 186; 106776; Mar. 2020; 25 Pages.
Ali et al.; "New Insights into Carbonate Matrix Acidizing Treatments: A Mathematical and Experimental Study"; SPE 200472; SPE Journal; Jun. 2020; pp. 1272-1284.
Baghel et al.; "A Semi-Empirical Carbonate Acidizing Model for Chelating-Agent-Based Fluids"; IADC/SPE-180590-MS; SPE International; Aug. 22-24, 2016; 9 Pages.
Bazin; "From Matrix Acidizing to Acid Fracturing: A Laboratory Evaluation of Acid/Rock Interactions"; Society of Petroleum Engineers; SPE Productions & Facilities; Feb. 2001; pp. 22-29.
Buijse et al.; "A Semiempirical Model to Calculate Wormhole Growth in Carbonate Acidizing"; SPE 96892; SPE International; Oct. 9-12, 2005; 14 Pages.
Burton et al.; "Improved Understanding of Acid Wormholing in Carbonate Reservoirs Through Laboratory Experiments and Field Measurements"; Society Petroleum Engineers; SPE-191625-MS; 2018; 34 Pages.
Conway et al.; "A Comparative Study of Straight/Gelled/Emulsified Hydrochloric Acid Diffusivity Coefficient Using Diaphragm Cell and Rotating Disk"; Society Petroleum Engineers; SPE International; SPE 56532; Oct. 3-6, 1999; 11 Pages.
Dong et al.; "The Effect of Core Dimensions on the Optimum Acid Flux in Carbonate Acidizing"; Society of Petroleum Engineers; SPE International; SPE 168146; 2014; 10 Pages.
Dong et al.; "The Role of Temperature on Optimal Conditions in Dolomite Acidizing: An Experimental Study and its Applications"; Journal of Petroleum Science and Engineering; vol. 165; 2018; pp. 736-742.
Fredd et al.; "Optimum Conditions for Wormhole Formation in Carbonate Porous Media: Influence of Transport and Reaction"; Society Petroleum Engineers; SPE Journal; vol. 4, No. 3; Sep. 1999; pp. 196-205.
Furui et al.; "A Comprehensive Model of High-Rate Matrix-Acid Stimulation for Long Horizontal Wells in Carbonate Reservoirs: Part 1—Scaling Up Core-Level Acid Wormholing to Field Treatments"; SPE Journal; Mar. 2012; pp. 271-279.
International Search Report and Written Opinion Issued in International Application No. PCT/US2023/011106 dated May 2, 2023; 9 Pages.
Karale et al.; "HP/HT Carbonate Acidizing—Recent Discoveries and Contradictions in Wormhole Phenomenon"; OTC-26714-MS; Offshore Technology Conference; Mar. 22-25, 2016; 23 Pages.
Mcduff et al.; "Understanding Wormholes in Carbonates: Unprecedented Experimental Scale and 3D Visualization"; Technology Today Series; JPT; Oct. 2010; pp. 78-81.
Qiu et al.; "Experimental Investigation of Radial and Linear Acid Injection into Carbonates for Well Stimulation Operations"; Society of Petroleum Engineers; SPE-192261-MS; Apr. 23-26, 2018; 15 Pages.
Rabie et al.; "Effect of Acid Additives on the Reaction of Stimulating Fluids During Acidizing Treatments"; Society of Petroleum Engineers; SPE-175827-MS; 2015; 27 Pages.
Schwalbert et al.; "A New Up-Scaled Wormhole Model Grounded on Experimental Results and in 2-Scale Continuum Simulations"; SPE-193616-MS; Spe International; Apr. 8-9, 2019; 30 Pages.
Sibarani et al.; "The Impact of Pore Structure on Carbonate Stimulation Treatment Using VES-Based HCl"; Society of Petroleum Engineers; SPE International; SPE-192066-MS; 2018; 14 Pages.
Talbot et al.; "Beyond the Damkohler Number: A New Interpretation of Carbonate Wormholing"; SPE 113042; SPE International; Jun. 9-12, 2008; 9 Pages.
Tardy et al.; "An Experimentally Validated Wormhole Model for Self-Diverting and Conventional Acids in Carbonate Rocks Under Radial Flow Conditions"; SPE 107854; SPE International; European Formation Damage Conference; May 30-Jun. 1, 2007; 17 Pages.
Wang et al.; "The Optimum Injection Rate for Matrix Acidizing of Carbonate"; Society of Petroleum Engineers; SPE 26578; 1993; pp. 675-687.
Zakaria et al.; "Flow of Emulsified Acid in Carbonate Rocks"; American Chemical Society; Industrial & Engineering Chemistry Research; 2015; vol. 54; pp. 4190-4202.
Zakaria et al.; "Predicting the Performance of the Acid-Stimulation Treatments in Carbonate Reservoirs With Nondestructive Tracer Tests"; Society of Petroleum Engineers; SPE Journal; Dec. 2015; pp. 1238-1253.

* cited by examiner

MODELING ACID FLOW IN A FORMATION

CROSS-REFERENCE TO RELATED APPLICATIONS

This application claims the benefit of U.S. Provisional Patent Application Ser. No. 63/301,922 filed Jan. 21, 2022, the disclosure of which is incorporated herein by reference in its entirety.

BACKGROUND

Embodiments described herein relate generally to downhole exploration and production efforts in the resource recovery industry and more particularly to techniques for modeling acid flow for acid stimulation of a formation.

Stimulation of hydrocarbon production increases production by improving the flow of hydrocarbons into a borehole from a reservoir. Various techniques may be employed to stimulate hydrocarbon production. For example, acid stimulation may be performed, in which an acid is flowed downhole within a tubular disposed in a borehole and released into the borehole to treat the formation and stimulate fluid flow into or from the formation. After release of the acid from the tubular, hydrocarbons are received by the tubular.

SUMMARY

In one embodiment, a method for modeling acid flow for acid stimulation of a formation is provided. The method includes receiving data about the acid stimulation. The method further includes modeling, by applying the data about the acid stimulation to a model, a wormhole velocity of an acid injected into the formation during the acid stimulation, wherein the wormhole velocity is a function of a Darcy velocity of the acid. The method further includes determining whether the wormhole velocity satisfies a wormhole velocity threshold. The method further includes, responsive to determining that the wormhole velocity fails to satisfy the wormhole velocity threshold, modifying a stimulation parameter to adjust the wormhole velocity of the acid. The method further includes performing the acid stimulation based at least in part on the modified stimulation parameter.

In another embodiment a system for modeling acid flow for acid stimulation of a formation is provided. The system includes a processing system for executing computer readable instructions, the computer readable instructions controlling the processing system to perform operations. The operations include receiving data about the acid stimulation. The operations further include modeling, by applying the data about the acid stimulation to a model, a wormhole velocity of an acid injected into the formation during the acid stimulation, wherein the model is a radial model, and wherein the radial model is upscaled from a linear model. The operations further include determining whether the wormhole velocity satisfies a wormhole velocity threshold. The operations further include, responsive to determining that the wormhole velocity fails to satisfy the wormhole velocity threshold, modifying a stimulation parameter to adjust the wormhole velocity of the acid. The operations further include performing the acid stimulation based at least in part on the modified stimulation parameter.

Other embodiments of the present invention implement features of the above-described method in computer systems and computer program products.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

Referring now to the drawings wherein like elements are numbered alike in the several figures.

DETAILED DESCRIPTION

Apparatuses, systems and methods are provided for performing, facilitating, and/or modeling stimulation of subterranean formations for, e.g., hydrocarbon production. An example of a stimulation process is acid stimulation.

Figure 1:
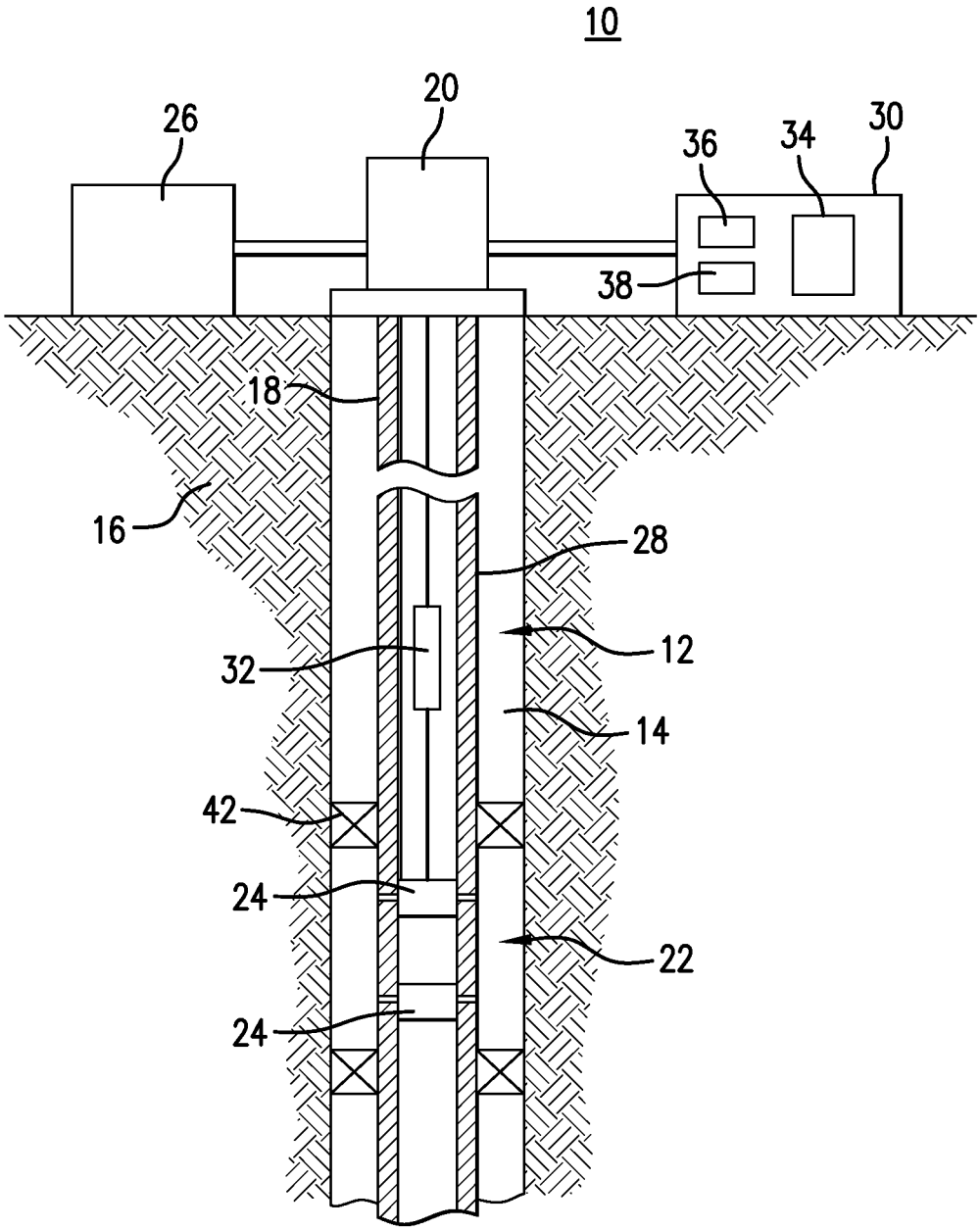
FIG. 1 depicts block diagram of a system for well production and/or stimulation according to one or more embodiments described herein.

Referring to FIG. 1, an embodiment of a hydrocarbon production stimulation system 10, which operates at a wellbore operation, includes a borehole string 12 configured to be disposed in a borehole 14 that penetrates at least one earth formation 16. The borehole may be an open hole, a cased hole, or a partially cased hole. In one embodiment, the borehole string 12 is a production string that includes a tubular 18, such as a pipe (e.g., multiple pipe segments) or coiled tubing, that extends from a wellhead 20 at a surface location (e.g., at a drill site or offshore stimulation vessel). A "borehole string" as described herein may refer to any structure suitable for being lowered into a wellbore or for connecting a drill or downhole tool to the surface, and is not limited to the structure and configuration described herein. For example, the borehole string may be configured as a wireline tool, coiled tubing, a drillstring, or a logging while drilling (LWD) string.

The hydrocarbon production stimulation system 10 includes one or more stimulation assemblies 22 configured to control injection of stimulation fluid and direct stimulation fluid into one or more production zones in the formation 16. Each stimulation assembly 22 includes one or more injection or flow control devices 24 configured to direct stimulation fluid from a conduit in the tubular 18 to the borehole 14. As used herein, the term "fluid" or "fluids" includes liquids, gases, hydrocarbons, multi-phase fluids, mixtures of two of more fluids, water and fluids injected from the surface, such as water or stimulation fluids. Stimulation fluids may include any suitable fluid used to reduce or eliminate an impediment to fluid production. A fluid source 26 may be coupled to the wellhead 20 and injected into the borehole string 12.

In one embodiment, the stimulation fluid is an acid stimulation fluid. Examples of acid stimulation fluids include acids such as, but not limited to, hydrochloric acid (HCl), hydrofluoric acid, acetic acid, formic acid, sulfamic acid, chloracetic acid, carboxylic acids, organic acids and chelating agents, retarded acids, any other acid capable of dissolving the subterranean formation, and any combination thereof. Examples of chelating agents that may be suitable for use in accordance with one or more embodiments described herein include, but are not limited to, ethylenediaminetetraacetic acid ("EDTA"), glutamic acid N,N-diacetic acid ("GLDA"), and any combination thereof. Acid stimulation is useful for, e.g., removing the skin on the borehole wall that can form when a wellbore is formed in a formation, such as a carbonate formation or another suitable type of formation.

The flow control devices 24 may be any suitable structure or configuration capable of injecting or flowing stimulation fluid from the borehole string 12 and/or tubular 18 to the borehole. Examples flow control devices include flow apertures, flow input or jet valves, injection nozzles, sliding sleeves and perforations. In one embodiment, acid stimulation fluid is injected from the surface fluid source 26 through the tubular 18 to a sliding sleeve interface configured to provide fluid communication between the tubular 18 and a borehole annulus. The acid stimulation fluid can be injected into an annulus formed between the tubular 18 and the borehole wall and/or from an end of the tubular, e.g., from a coiled tubing.

Various sensors or sensing assemblies may be disposed in the system to measure downhole parameters and conditions. For example, pressure and/or temperature sensors may be disposed at the production string at one or more locations (e.g., at or near injection devices 24). Other types of sensors can also be implemented. Such sensors may be configured as discrete sensors such as pressure/temperature sensors or distributed sensors. An example distributed sensor is a Distributed Temperature Sensor (DTS) assembly 28 that is disposed along a selected length of the borehole string 12. The DTS assembly 28 extends, for example, along the entire length of the string 12 between the surface and the end of the string (e.g., a toe end) or extends along selected length(s) corresponding to injection devices 24 and/or production zones. According to an embodiment, the DTS assembly 28 is configured to measure temperature continuously or intermittently along a selected length of the string 12 and includes at least one optical fiber that extends along the string 12 (e.g., on an outside surface of the string or the tubular 18). Temperature measurements collected via the DTS assembly 28 can be used in a model to estimate fluid flow parameters in the string 12 and the borehole 14 (e.g., to estimate acid distribution in the formation 16 and/or production zones).

It is understood that one or more embodiments described herein are capable of being implemented in conjunction with any suitable type of computing environment now known or later developed. In one embodiment, the DTS assembly 28, the injection assemblies 24, and/or other components are in communication with one or more processing systems, such as a surface processing unit 30 and/or a downhole electronics unit 32. The communication incorporates any of various transmission media and connections, such as wired connections, fiber optic connections, and wireless connections. The surface processing unit 30, the downhole electronics unit 32, and/or the DTS assembly 28 can include components to provide for processing, storing, and/or transmitting data collected from various sensors associated therewith.

Examples of components include, without limitation, at least one processor, storage, memory, input devices, output devices, and the like. For example, the surface processing unit 30 includes a processor 34 including a memory 36 and configured to execute software for processing measurements and generating a model as described below. As examples, one or more of the embodiments described herein can be implemented as instructions stored on a computer-readable storage medium, as hardware modules, as special-purpose hardware (e.g., application specific hardware, application specific integrated circuits (ASICs), application specific special processors (ASSPs), field programmable gate arrays (FPGAs), as embedded controllers, hardwired circuitry, etc.), or as some combination or combinations of these. According to aspects of the present disclosure, the features and functionality described herein can be a combination of hardware and programming. The programming can be processor executable instructions stored on a tangible memory, and the hardware can include the processor 34 for executing those instructions. Thus a system memory (e.g., the memory 36) can store program instructions that when executed by the processor 34 implement the features and functionality described herein.

Figure 2:
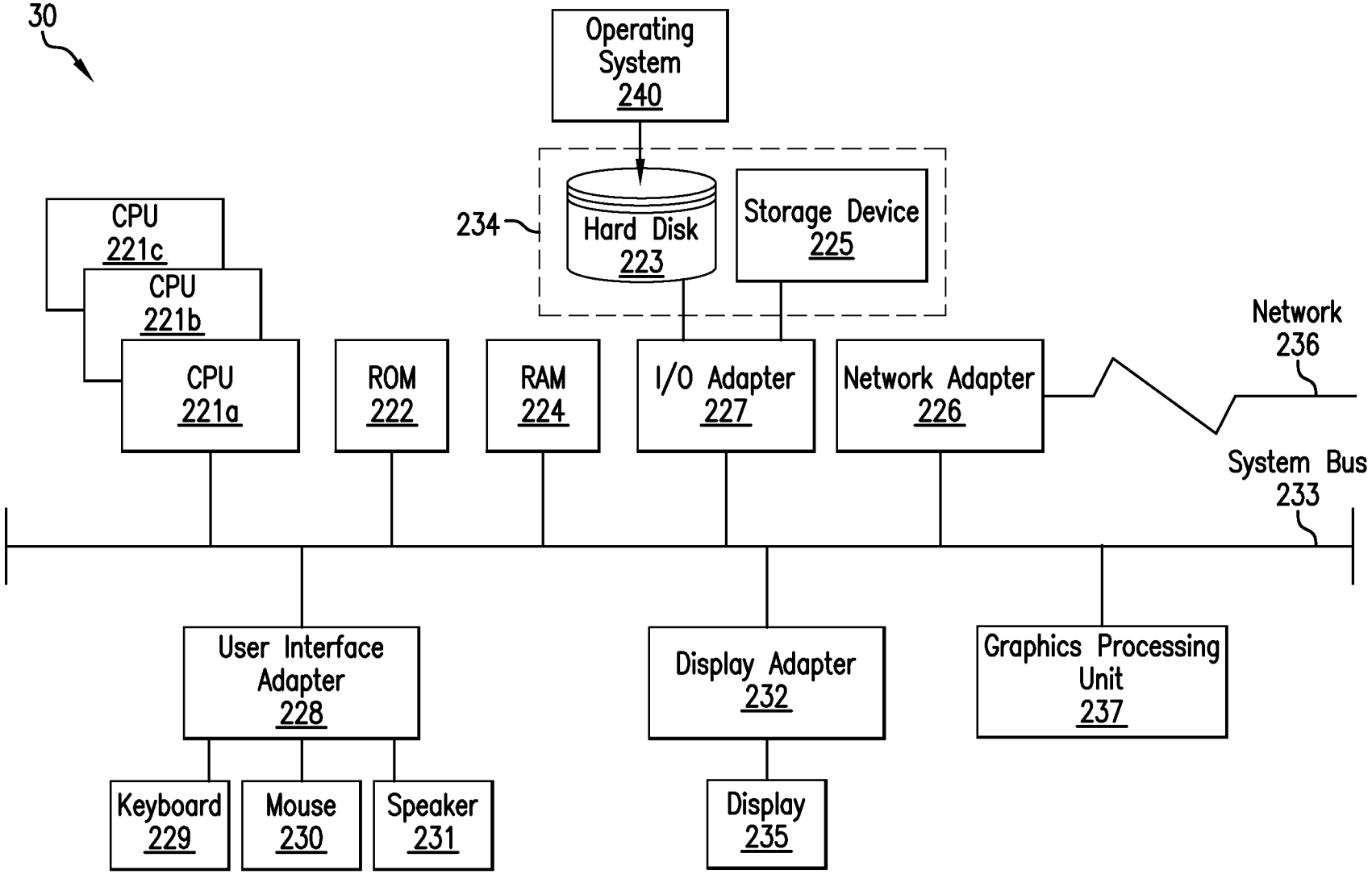
FIG. 2 depicts a block diagram of the surface processing unit of FIG. 1, which can be used for implementing the techniques according to one or more embodiments described herein.

FIG. 2 depicts a block diagram of the surface processing unit 30 of FIG. 1, which can be used for implementing the techniques described herein. In examples, the surface processing unit 30 has one or more central processing units 221*a*, 221*b*, 221*c*, etc. (collectively or generically referred to as processor(s) 221 and/or as processing device(s) 221). In aspects of the present disclosure, each processor 221 can include a reduced instruction set computer (RISC) microprocessor. Processors 221 are coupled to system memory (e.g., random access memory (RAM) 224) and various other components via a system bus 233. Read only memory (ROM) 222 is coupled to system bus 233 and can include a basic input/output system (BIOS), which controls certain basic functions of surface processing unit 30.

Further illustrated are an input/output (I/O) adapter 227 and a network adapter 226 coupled to system bus 233. I/O adapter 227 can be a small computer system interface (SCSI) adapter that communicates with a memory, such as a hard disk 223 and/or a tape storage device 225 or any other similar component. I/O adapter 227 and memory, such as hard disk 223 and tape storage device 225 are collectively referred to herein as mass storage 234. Operating system 240 for execution on the surface processing unit 30 can be stored in mass storage 234. The network adapter 226 interconnects system bus 233 with an outside network 236 enabling the surface processing unit 30 to communicate with other systems.

A display 235 (e.g., a display monitor) is connected to system bus 233 by display adaptor 232, which can include a graphics adapter to improve the performance of graphics intensive applications and a video controller. In one aspect of the present disclosure, adapters 226, 227, and/or 232 can be connected to one or more I/O busses that are connected to system bus 233 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 233 via user interface adapter 228 and display adapter 232. A keyboard 229, mouse 230, and speaker 231 can be interconnected to system bus 233 via user interface adapter 228, which can include, for example, a Super I/O chip integrating multiple device adapters into a single integrated circuit.

In some aspects of the present disclosure, the surface processing unit 30 includes a graphics processing unit 237. Graphics processing unit 237 is a specialized electronic circuit designed to manipulate and alter memory to accelerate the creation of images in a frame buffer intended for output to a display. In general, graphics processing unit 237 is very efficient at manipulating computer graphics and image processing and has a highly parallel structure that makes it more effective than general-purpose CPUs for algorithms where processing of large blocks of data is done in parallel.

Thus, as configured herein, the surface processing unit 30 includes processing capability in the form of processors 221, storage capability including system memory (e.g., RAM 224 and/or mass storage 234), input means such as keyboard 229 and mouse 230, and output capability including speaker 231 and display 235. In some aspects of the present disclosure, a portion of system memory (e.g., RAM 224 and mass storage 234) collectively store the operating system 240 to coordinate the functions of the various components shown in the surface processing unit 30.

One or more embodiments described herein provides for modeling acid distribution for acid stimulation of a formation to predict wormhole growth during matrix acidizing. Matrix acidizing is a stimulation process wherein acid is injected into a wellbore to penetrate rock pores. Matrix acidizing is a method applied for removing formation damage from pore plugging caused by mineral deposition. The acids, usually inorganic acids, such as fluoridic (HF) and or cloridic (HCl) acids, are pumped into the formation at or below the formation fracturing pressure in order to dissolve the mineral particles by chemical reactions. The acid creates high-permeability, high productivity flow channels called wormholes and bypasses the near-wellbore damage. The operation time depends on such parameters as the length of the wellbore, the rock type, severity of the damage, acid pumping rate, downhole conditions and other factors. It may be desirable to predict wormhole growth in order to improve hydrocarbon recovery.

One or more embodiments described herein implements a model that uses Darcy velocity instead of fluid interstitial velocity to accurately simulate wormhole growth and provide prediction capabilities. Using Darcy velocity instead of interstitial velocity improves wormhole modeling by eliminating the effect of porosity on wormhole velocity. Darcy velocity is a flow per unit cross sectional area of a porous medium. Darcy velocity can be expressed in terms of instantaneous flux of a fluid flowing through a porous medium, a permeability of the porous medium, a dynamic viscosity of the fluid flowing through the porous medium, and a pressure drop over a given distance.

Conventionally, a semi-empirical model may be used to predict wormhole growth under linear flow. Such models are based on fluid interstitial velocity. In such cases, the wormhole velocity is described as shown in the following equation:

$$V_{wh} = W_{eff} * V_i^{\frac{2}{3}} * \left(1 - \exp\left(-W_B * V_i^2\right)\right)^2$$

where $V_{wh}$ is the wormhole velocity, $V_i$ is the fluid interstitial velocity, $W_{eff}$ is the wormhole efficiency factor, and $W_b$ is the wormhole B-factor. It should be appreciated that this model is only based on linear laboratory data, not field data.

The following equations provide approximate expressions for $W_{eff}$ and $W_b$ based on optimum conditions:

$$W_{eff} = \frac{V_{i-opt}^{1/3}}{PVBT_{opt}}$$

-continued $$W_B = \frac{4}{V_{i-opt}^2}$$

where $V_{i-opt}$ is an optimum fluid interstitial velocity and $PVBT_{opt}$ is the pore volume to breakthrough at the optimum fluid interstitial velocity $V_{i-opt}$.

This conventional model uses the interstitial velocity (q/Aφ), which implies that porosity (φ) controls wormhole growth. However, rock type controls the wormhole growth, not the porosity, and this conventional model does not account for rock type. Thus, this conventional model is inadequate because it fails to eliminate the effect of porosity (which can vary, for example, based on rock type) on wormhole velocity.

A modified version of this conventional model introduced a morphology factor and changed the interstitial velocity power under the exponent. Additionally, $W_{eff}$ and $W_b$ were presented as functions in acid concentration, temperature, and core aspect ratio. The modified version of the model is expressed by the following function:

$$V_{wh}=W_{eff}*(\mathrm{MF}*V_i)^{2/3}*(1-\exp(-W_B*(\mathrm{MF}*V_i)^{2/3}))^2$$

where MF is the morphology factor. The morphology factor is a function of permeability and porosity. Note that the morphology factor is multiplied by $V_i$, which indicates that rock type (porosity and permeability) controls wormhole growth, not only porosity. It should be appreciated that this model is based on linear laboratory data, not field data.

One or more embodiment described herein address these and other shortcomings of the conventional models of the prior art by modeling acid distribution for acid stimulation of a formation to predict wormhole growth during matrix acidizing where the modeling uses Darcy velocity instead of interstitial velocity. Using Darcy velocity improves conventional approaches to wormhole modeling by eliminating the effect of porosity on wormhole velocity. For example, one or more embodiments provides for more accurate acid placement designs compared to conventional modeling approaches. One or more embodiments provides an upscaling scheme based on a conceptual model validated by experimental data, numerical modeling, and/or field data to simulate acid flow under well (radial) flow conditions. One or more embodiments can use rock type for scaling. One or more embodiments account for rock minerology, temperature, acid concentration, acid type, and additives in designs. These and other advantages will be apparent as further described herein.

According to one or more embodiments, the model described herein uses Darcy velocity, where $W_{eff}$ and $W_b$ are functions of acid concentration, diffusion coefficient, core length, core area, minerology, additives, and permeability. The model can be expressed by the following equation:

The following equations express the model according to one or more embodiments described herein.

$$V_{wh} = W_{eff} * (V)^{e1} * \left(1 - \exp\left(-W_B * (V)^{e2}\right)\right)^{e3}$$

$$W_{eff} = W_{eff_l} * W_{eff_a} * W_{eff_c} * W_{eff_t} * W_{eff_r} * W_{eff_for} * W_{eff_m}$$

$$W_{eff_a} = a_1 * A^{a2}$$

$$W_{eff_l} = a_3 * e^{-l*a_4}$$

$$W_{eff_c} = a_5 * C_{Ao}^{a6}$$

-continued $$W_{eff_t} = a_7 * D^{a_8}$$

$$W_{eff_r} = a_9 + \frac{a_{10}}{1 + \left(\frac{K}{a_{11}}\right)^{a_{12}}}$$

$$W_{eff_m} = \begin{cases} \text{limestone}, & 1 \\ \text{dolomite}, & a_{13} + \dfrac{a_{14}}{\left(1 + \left(\dfrac{T}{a_{15}}\right)^{a_{16}}\right)^{a_{17}}} \end{cases}$$

$$W_b = W_{b_l} * W_{b_a} * W_{b_c} * W_{b_t} * W_{b_for} * W_{b_m}$$

$$W_{b_a} = b_1 * A^{b_2}$$

$$W_{b_l} = b_3 * l^{b_4}$$

$$W_{b_c} = b_5 * C_{Ao}^{b_6}$$

$$W_{b_t} = b_7 * D^{b_8}$$

$$W_{b_m} = \begin{cases} \text{limestone}, & 1 \\ \text{dolomite}, & b_9 + \dfrac{b_{10}}{\left(1 + \left(\dfrac{T}{b_{11}}\right)^{b_{12}}\right)^{b_{13}}} \end{cases}$$

In these equations, $a_1$-$a_{17}$, $b_1$-$b_{12}$, and e1-e3 are tuning parameters, which can be derived from and tuned using experimental data including laboratory and/or field data, V is Darcy velocity in m/s, A is the cross-sectional area in $m^2$, l is the length of the core/wormhole in m, $C_{Ao}$ is the acid concentration at the inlet in fraction, D is the diffusion coefficient in $m^2/s$, K is the permeability in millidarcy (md), T is the temperature in Kelvin, and $W_{eff_for}$ and $W_{b_for}$ are tuning parameters that depend on acid formulation/additives.

According to one or more embodiments described herein, the pore volume to breakthrough (PVBT) is a function of wormhole velocity and fluid interstitial velocity and is calculated using the following equation:

$$PVBT = \frac{V_i}{V_{wh}}$$

Figure 3:
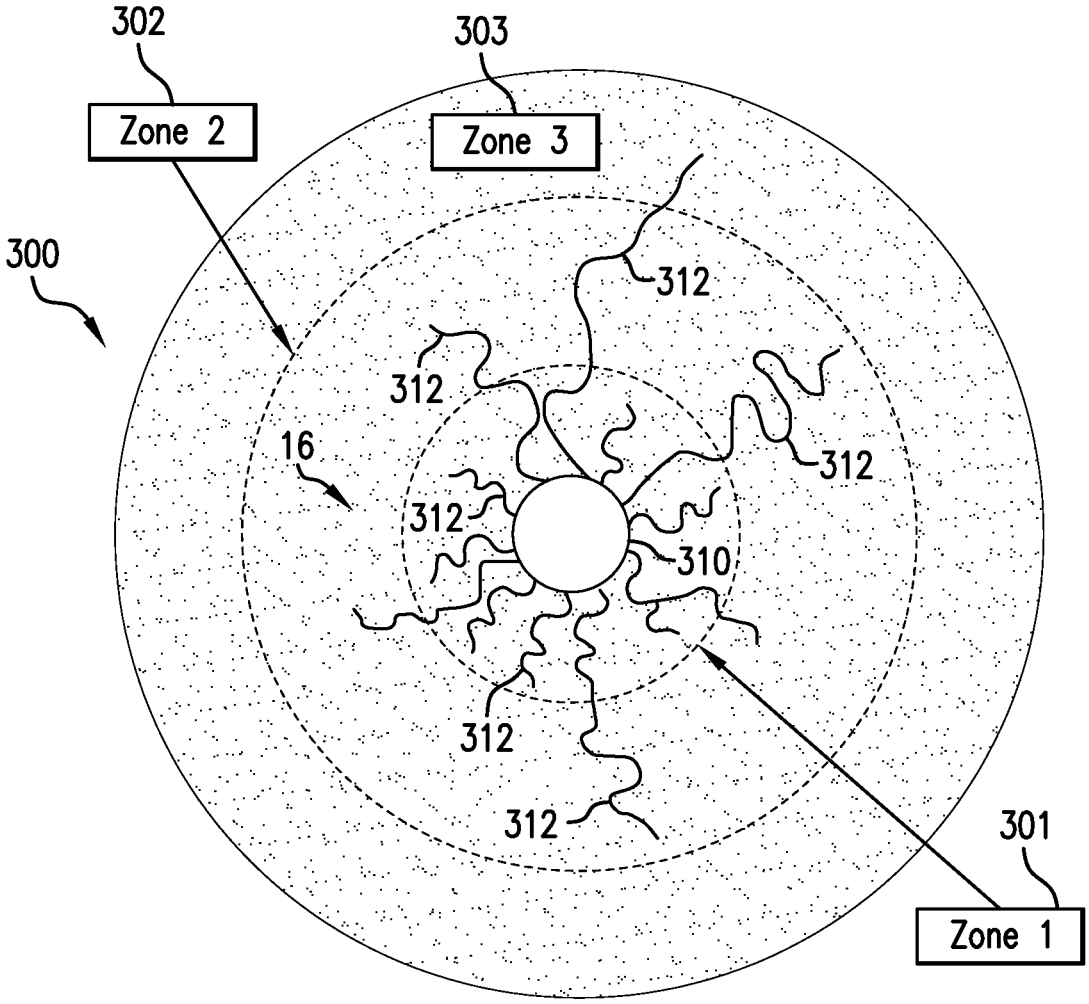
FIG. 3 depicts a conceptual diagram of acid flow in radial geometry according to one or more embodiments described herein.

The model can be upscaled from linear applications to radial applications. The upscaling from linear to radial is based on the conceptual diagram 300 shown in FIG. 3. In particular, FIG. 3 depicts a conceptual diagram 300 of acid flow in radial geometry according to one or more embodiments described herein. The diagram 300 shows a wellbore 310 through the earth formation 16. Zones, including zone 1 301, zone 2 302, and zone 3 303 extend radially outward (away) from the wellbore 310. As shown, wormholes 312 also extend through the zones radially outward from the wellbore 310. Fluid, such as stimulation fluid, is directed through the wellbore 310 and into the wormholes 312 such as using one or more stimulation assemblies 22.

Zone 1 301 has a high acid consumption due to a high number of wormholes and a low fluid velocity (radial flow). In zone 2 302, the number of wormholes decreases, resulting in a higher acid velocity (pseudo-linear flow) and less acid consumption but a higher wormhole velocity than zone 1 301. Zone 3 303 has a higher acid consumption than zone 1 301 and zone 2 302 due to diffusion. Zone 3 303 also represents the end of wormhole growth.

At the start of the injection (zone 1 301), acid flows radially outward (away from the wellbore 310 near the wellbore 310. Acid accesses the pores within the formation 16; wormhole velocity decreases with acid invasion depth (away from the wellbore 310). As acid travels farther (i.e., deeper) into the formation (zone 2 302) relative to the wellbore 310, acid generates preferential pathways; the number of wormholes decreases with acid invasion depth, resulting in higher wormhole velocity (Pseudo-linear flow). Farther still from the wellbore 310 (zone 3 303), the wormhole growth rate decreases due to the diffusion and the small amount of acid that reaches the tip of the wormhole. As can be seen from FIG. 3, the number of wormholes decreases as acid propagates radially far from the wellbore 310. The start, the end, and the length of zone 2 302 depends on the fluid velocity and acid reactivity with the formation 16. Acid radial flow is controlled by several factors: 1) the decrease in the fluid velocity due to the change in flow area, 2) the decrease in the number of wormholes (increase in the wormhole velocity), and 3) the amount of acid that reaches the tip of the wormhole (diffusion effect).

The model can be upscaled from a linear model to a radial model using upscaling parameters. For example, two upscaling parameters ($W_{eff_up}$ and $W_{b_up}$) can be manipulated by $W_{eff}$ and $W_b$ respectively, where $W_{eff_up}$ is a function of both wellbore flow area and wormhole length, and $W_{b_up}$ is a function of wellbore flow area. These two upscaling parameters ($W_{eff_up}$ and $W_{b_up}$), along with updating Darcy velocity as a function of radial flow area at the wormhole tip, can be used to upscale the model from linear to radial. The two upscaling parameters ($W_{eff_up}$ and $W_{b_up}$) are defined by the following equations.

$$W_{eff_up} = A_o^{a_{18}}\left(a_{19} + \frac{a_{20}}{\left(1 + \left(\frac{r_{wh}}{a_{21}}\right)^{a_{22}}\right)^{a_{23}}}\right)$$

$$W_{b_up} = A_o^{b_{14}}$$

In these equations, $a_{18}$-$a_{23}$ and $b_{14}$ are tuning parameters, which can be derived from and tuned using radial laboratory experiments, numerical models, and/or field data.

Figure 4:
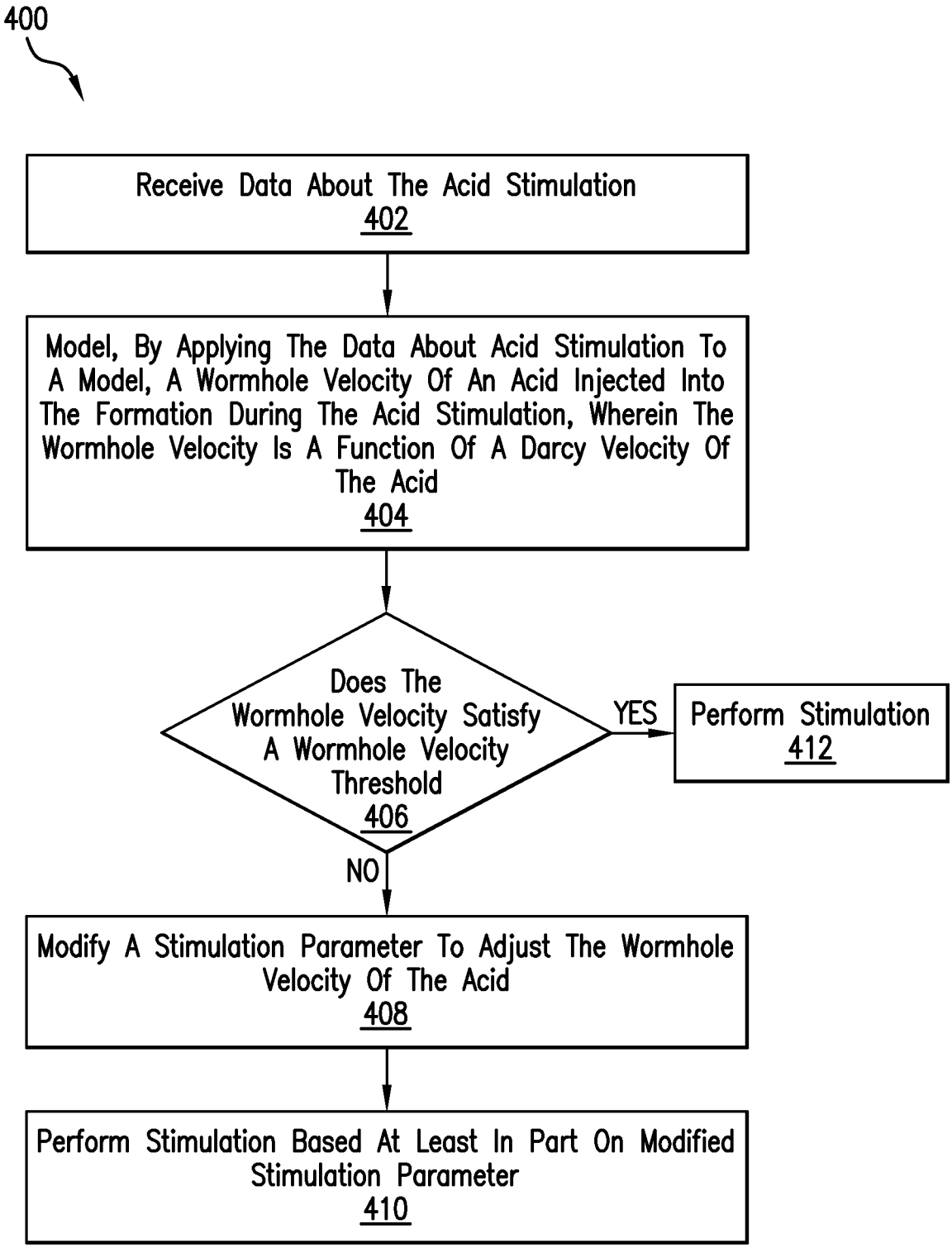
FIG. 4 depicts a flow diagram of a method for modeling acid distribution for acid stimulation of a formation according to one or more embodiments described herein.

FIG. 4 depicts a flow diagram of a method for modeling acid distribution for acid stimulation of a formation according to one or more embodiments described herein. The method 400 can be performed by any suitable processing system downhole or on surface (e.g., the surface processing unit 30, the surface processing unit 30, a downhole electronics unit 32, a cloud computing node of a cloud computing environment, etc.), any suitable processing device (e.g., the processor 34, one of the processors 21), and/or combinations thereof or another suitable system or device.

At block 402, the surface processing unit 30 receives data about the acid stimulation. According to an embodiment, the data is linear core flow data. The data can be laboratory data, field data, and/or combinations thereof. According to one or more embodiments described herein, receiving the data can include collecting the data, such as in a laboratory environment, at a wellbore operation (e.g., in the field), and/or the like. For example, one or more sensors (e.g., temperature sensors, pressure sensors, etc.) can be used to collect the data.

At block 404, the surface processing unit 30 models, by applying the data about the acid stimulation to a model, a wormhole velocity of an acid injected into the formation during the acid stimulation. The wormhole velocity is a function of a Darcy velocity of the acid. According to one or more embodiments described herein, the model is expressed by the following equation:

$$V_{wh} = W_{eff} * (V)^{e1} * (1 - \exp(-W_B * (V)^{e2}))^{e3}$$

where $V_{wh}$ is the wormhole velocity, $W_{eff}$ is a wormhole efficiency factor, V is the Darcy velocity of the acid, $W_b$ is a wormhole B-factor, and e1, e2, and e3 are tuning parameters.

According to one or more embodiments described herein, the wormhole B-factor $W_b$ is a function of an acid concentration, a diffusion coefficient, a core length, a core area, and a corrosion inhibitor. According to one or more embodiments described herein, the wormhole efficiency factor $W_{eff}$ is a function of an acid concentration, a diffusion coefficient, a core length, a core area, and a corrosion inhibitor.

According to one or more embodiments described herein, the model is a radial model. The radial model can be upscaled from a linear model in one or more examples. For example, the radial model is upscaled from the linear model by applying upscaling parameters that are functions of a wellbore flow area and a wormhole length. As a further example, the radial model is upscaled from the linear model further by updating the Darcy velocity of the acid as a function of radial flow area at a wormhole tip.

At block 406, the surface processing unit 30 determines whether the wormhole velocity satisfies a wormhole velocity threshold. The wormhole velocity threshold can be preset, adjustable (e.g., manually, semi-automatically, automatically, etc.), and/or dynamic (e.g., depending on operating conditions, acid type, etc.). In some examples, it may be desirable for the wormhole velocity to exceed (e.g., be greater than, be greater than or equal to, etc.) the wormhole velocity threshold. In such cases, the wormhole velocity is said to satisfy the wormhole velocity threshold when the wormhole velocity is greater than (or equal to) the wormhole velocity threshold. In other examples, it may be desirable for the wormhole velocity not to exceed (e.g., be less than, be less than or equal to, etc.) the wormhole velocity threshold. In such cases, the wormhole velocity is said to satisfy the wormhole velocity threshold when the wormhole velocity is less than (or equal to) the wormhole velocity threshold.

If at block 406, it determined that the wormhole velocity fails to satisfy the wormhole velocity threshold, the surface processing unit 30 can modify a stimulation parameter (also referred to as a "stimulation treatment parameter") at block 408 to adjust the wormhole velocity of the acid. Examples of stimulation parameters can include a type of acid, an acid formulation, an acid concentration, and the like. At block 410, the hydrocarbon production stimulation system 10 performs the acid stimulation based at least in part on the modified stimulation parameter from block 408. That is, the hydrocarbon production stimulation system 10, using one or more of the stimulation assemblies 22, controls injection of stimulation fluid (e.g., acid stimulation fluid) and directs the stimulation fluid into one or more production zones in the formation 16.

If at block 406, it determined that the wormhole velocity satisfies the wormhole velocity threshold, the hydrocarbon production stimulation system 10 performs the acid stimulation using the acid at block 412.

Additional processes also may be included, and it should be understood that the process depicted in FIG. 4 represents an illustration, and that other processes may be added or existing processes may be removed, modified, or rearranged without departing from the scope of the present disclosure.

Various tuning and implementation aspects of the model are now described with reference to FIGS. 5A-18.

Figure 5A:
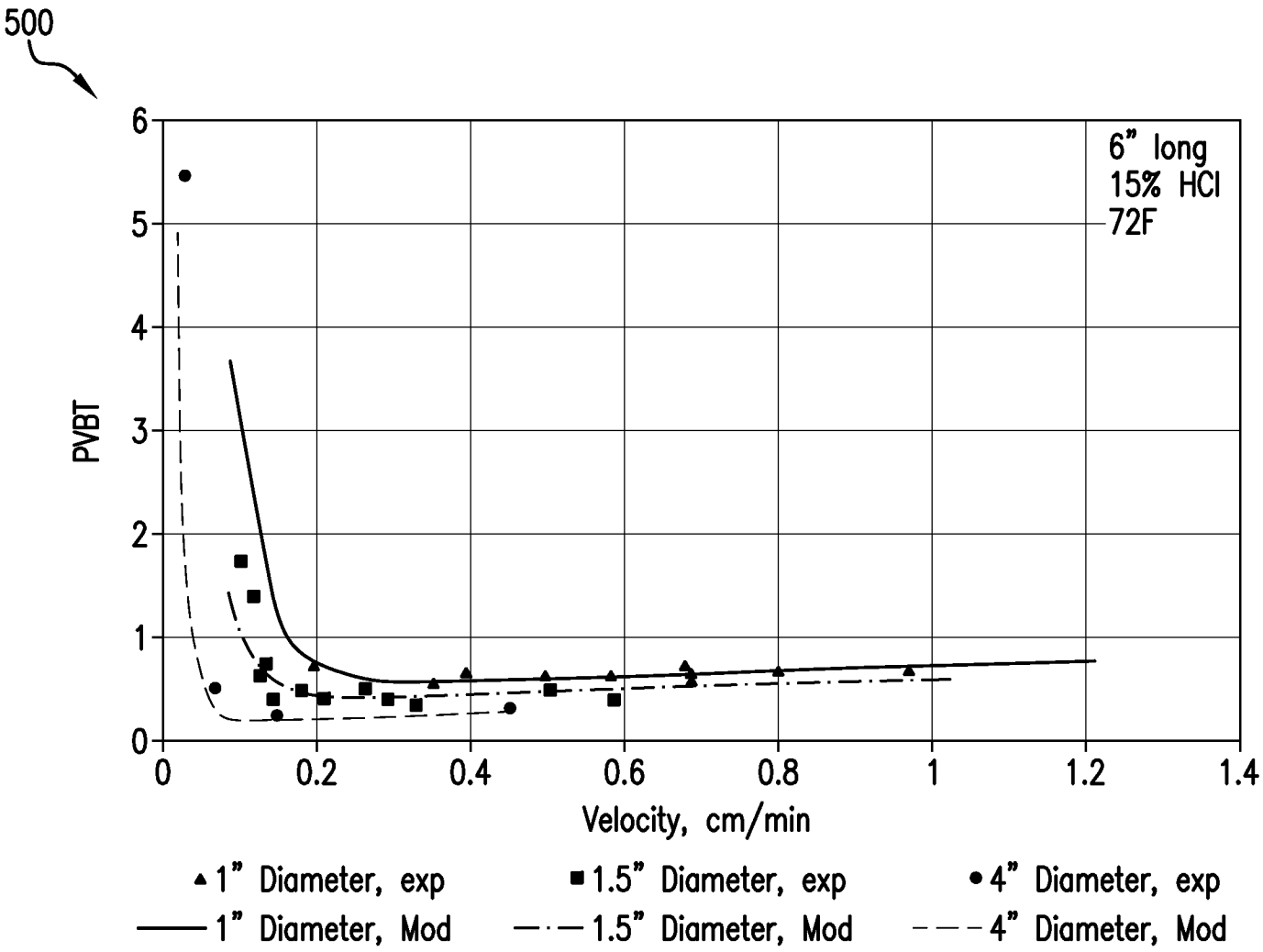
FIGS. 5A-19 depict graphs according to one or more embodiments described herein.
Figure 5B:
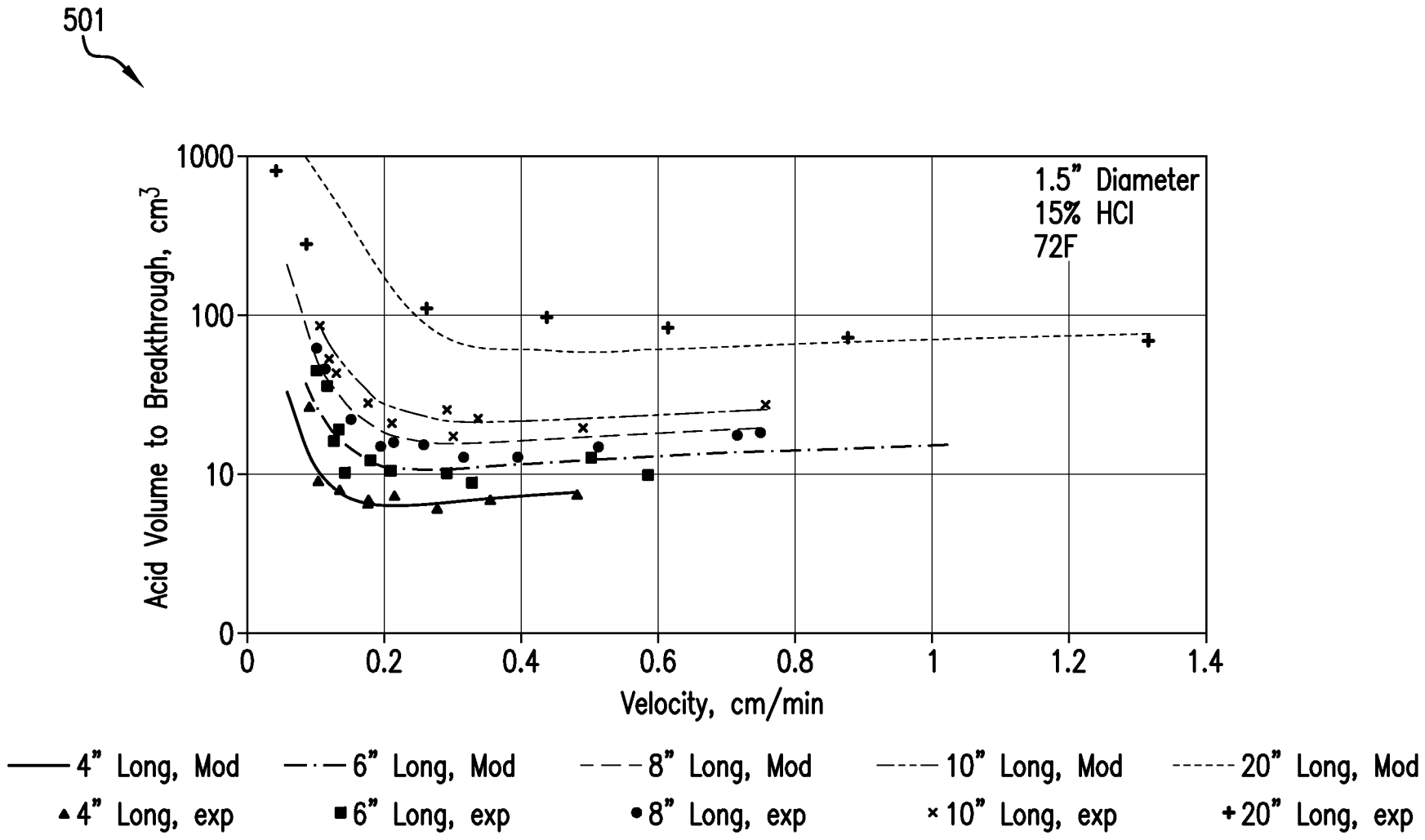

According to one or more embodiments described herein, the model can be tuned against HCl-limestone core-flood experiments with cores of differing lengths and/or diameters. FIG. 5A depicts a graph 500 of the experimental PVBT data of 6" long cores with different diameters and associated wormhole velocity predictions using the model. The graph 500 shows the effect of core diameter on acid linear flow. FIG. 5B depicts a graph 501 of the acid volume to breakthrough experiments of 1.5" diameter cores with different lengths and associated wormhole velocity predictions using the model. The graph 500 shows the effect of core length on acid linear flow. In these two figures, the points (squares, triangles, and circles) represent experimental data and the lines represent wormhole velocity predictions generated by the model as described herein.

Figure 6:
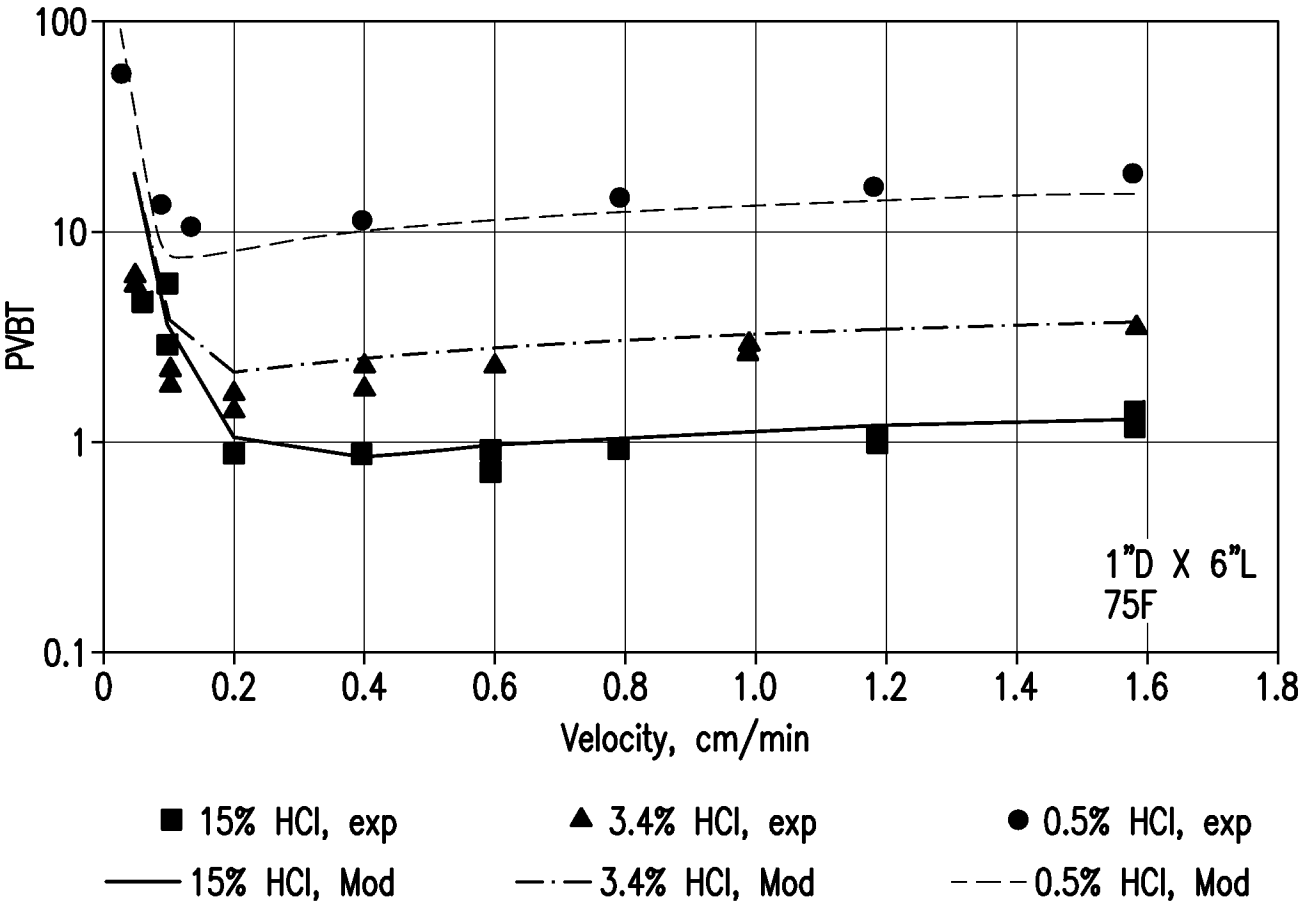

According to one or more embodiments described herein, the model can be turned for different acid concentrations. FIG. 6 depicts a graph 600 of experimental data at three different acid concentrations and model predictions associated therewith. The graph 600 shows the effect of acid concentration on the acid linear flow. In this figure, the points (squares, triangles, and circles) represent experimental data and the lines represent wormhole velocity predictions generated by the model as described herein.

Figure 7A:
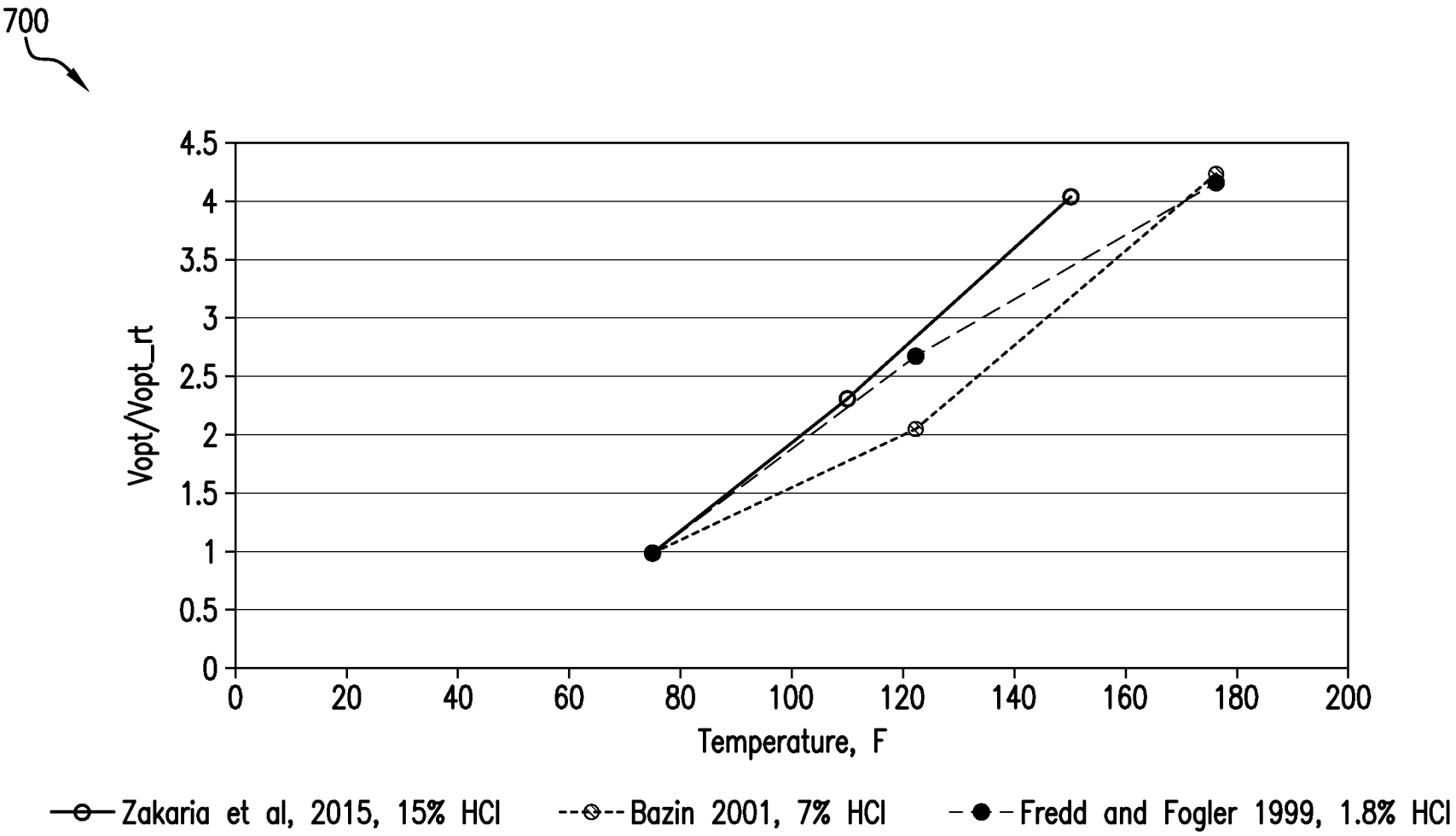
Figure 7B:
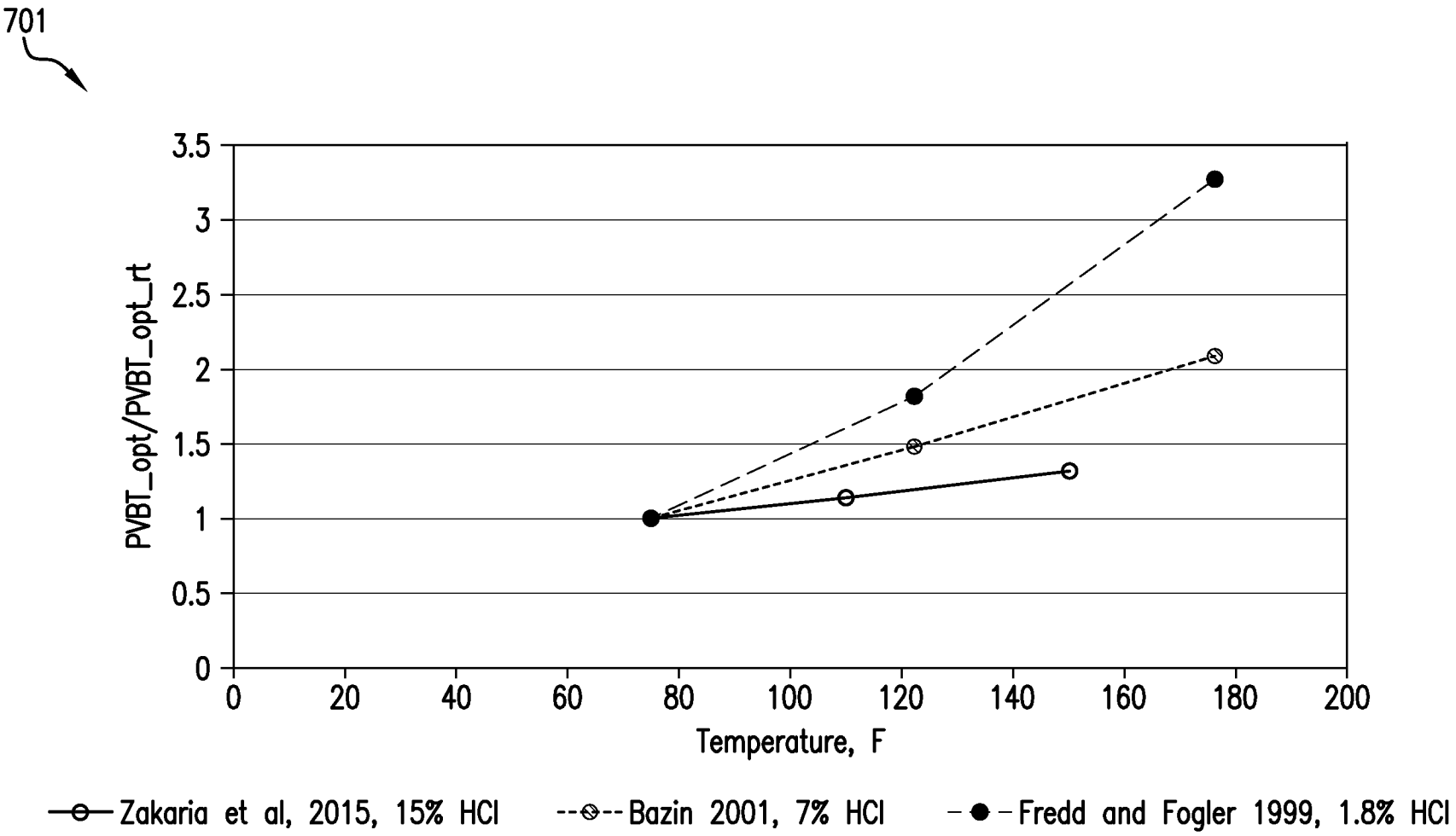

It can be observed that the effect of acid concentration and temperature are not completely separately. For example, FIG. 7A depicts a graph 700 that shows the effect of temperature on the normalized optimum wormhole velocity at three acid concentrations, while FIG. 7B depicts a graph 701 that shows the effect of temperature on normalized optimum PVBT. Particularly, the graph 701 shows that the higher the acid concentration, the lower the effect of temperature on the optimum PVBT. The graphs 700, 701 particularly show the effect of temperature on optimum PVBT at 18%, 7%, and 15% acid concentrations, for example. The wormhole velocity is controlled by the injection rate and the amount of acid that reaches the wormhole tip. The acid concentration at the tip of the wormhole can be calculated using the following equation:

$$C_A = C_{Ao} e^{-\frac{k l_{wh}}{v}}$$

where $C_A$ is the acid concentration at the tip of the wormhole, k is the effective reaction rate, $l_{wh}$ is the length of the wormhole, and v is the fluid velocity in the wormhole. The reaction rate increases with the temperature. A high reaction rate results in lower acid concentration at the wormhole tip. For the low acid concentration case, the acid concentration at the tip will be too low to support the propagation of the wormhole at constant velocity. This is translated into higher optimum PVBT with temperature for lower acid concentration cases. On the other hand, for the high acid concentration case, there will be enough acid at the tip to provide a relatively constant wormhole growth.

Figure 8A:
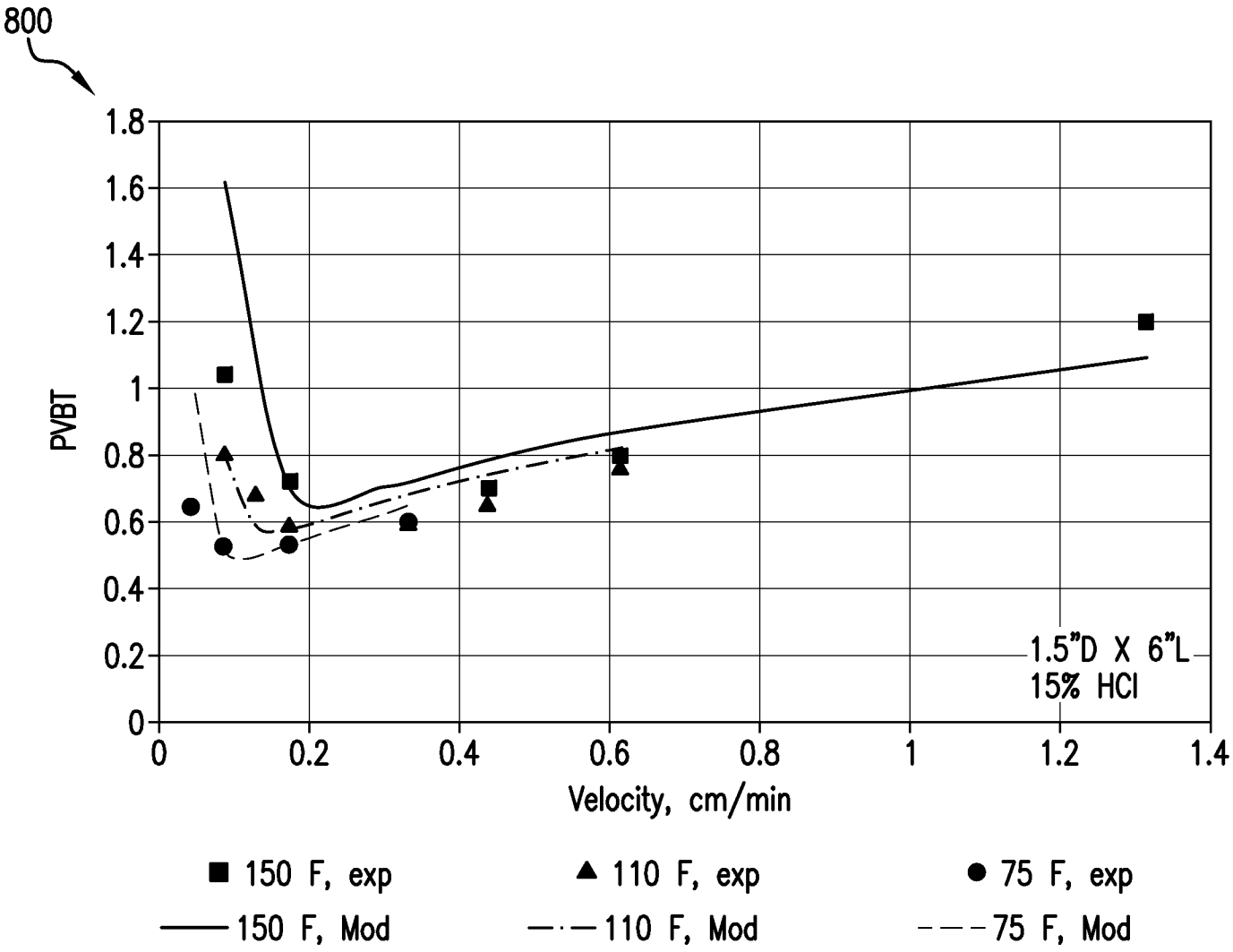

To achieve a suitable acid concentration, the diffusion coefficient can be modified to account for this behavior. The diffusion coefficient increases at a higher pace for lower acid concentrations to allow higher consumption and agree with experimental data. FIG. 8A depicts a graph 800 that shows the effect of temperature on limestone cores at different temperatures. The graph 800 shows the effect of temperature between 75° F. and 150° F. on acid flow. In this figure, the points (squares, triangles, and circles) represent experimental data and the lines represent wormhole velocity predictions generated by the model as described herein.

Figure 8B:
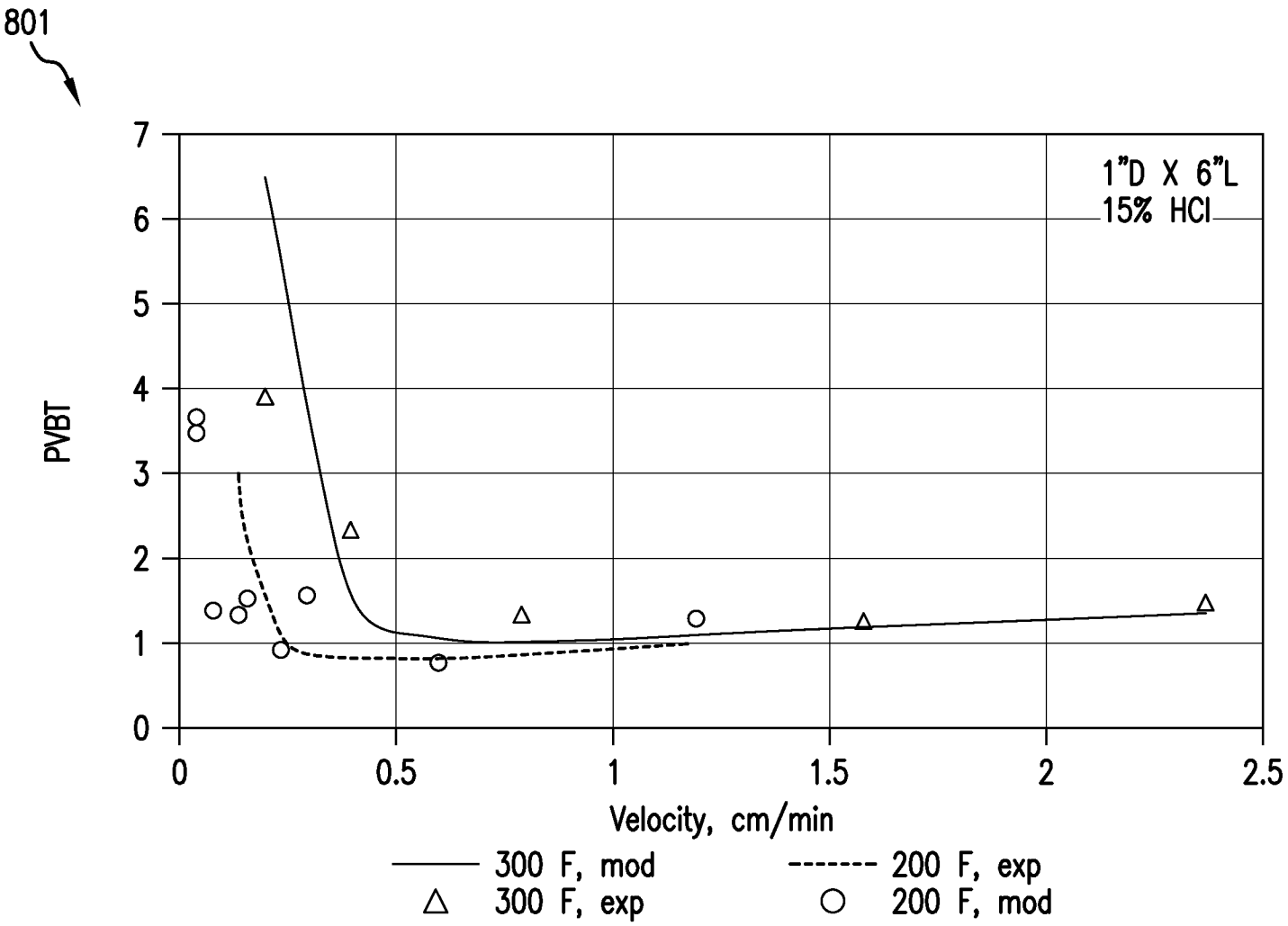

Similarly, the graph 801 of FIG. 8B shows the effect of temperature on limestone cores at different temperatures. The graph 801 shows the effect of temperature between 200° F. and 300° F. on acid flow. In this figure, the points (squares, triangles, and circles) represent experimental data and the lines represent wormhole velocity predictions generated by the model as described herein.

Figure 9A:
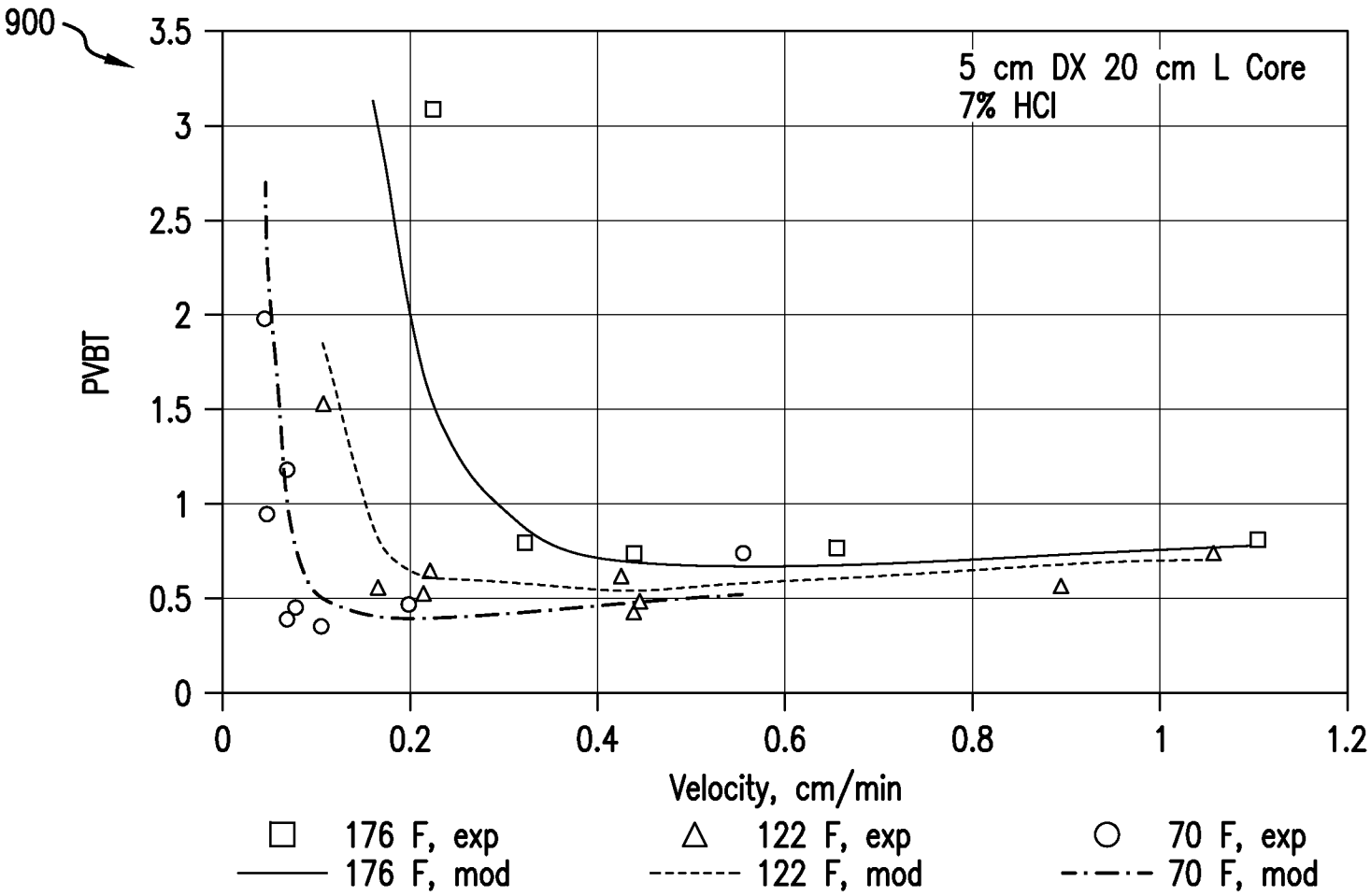
Figure 9B:
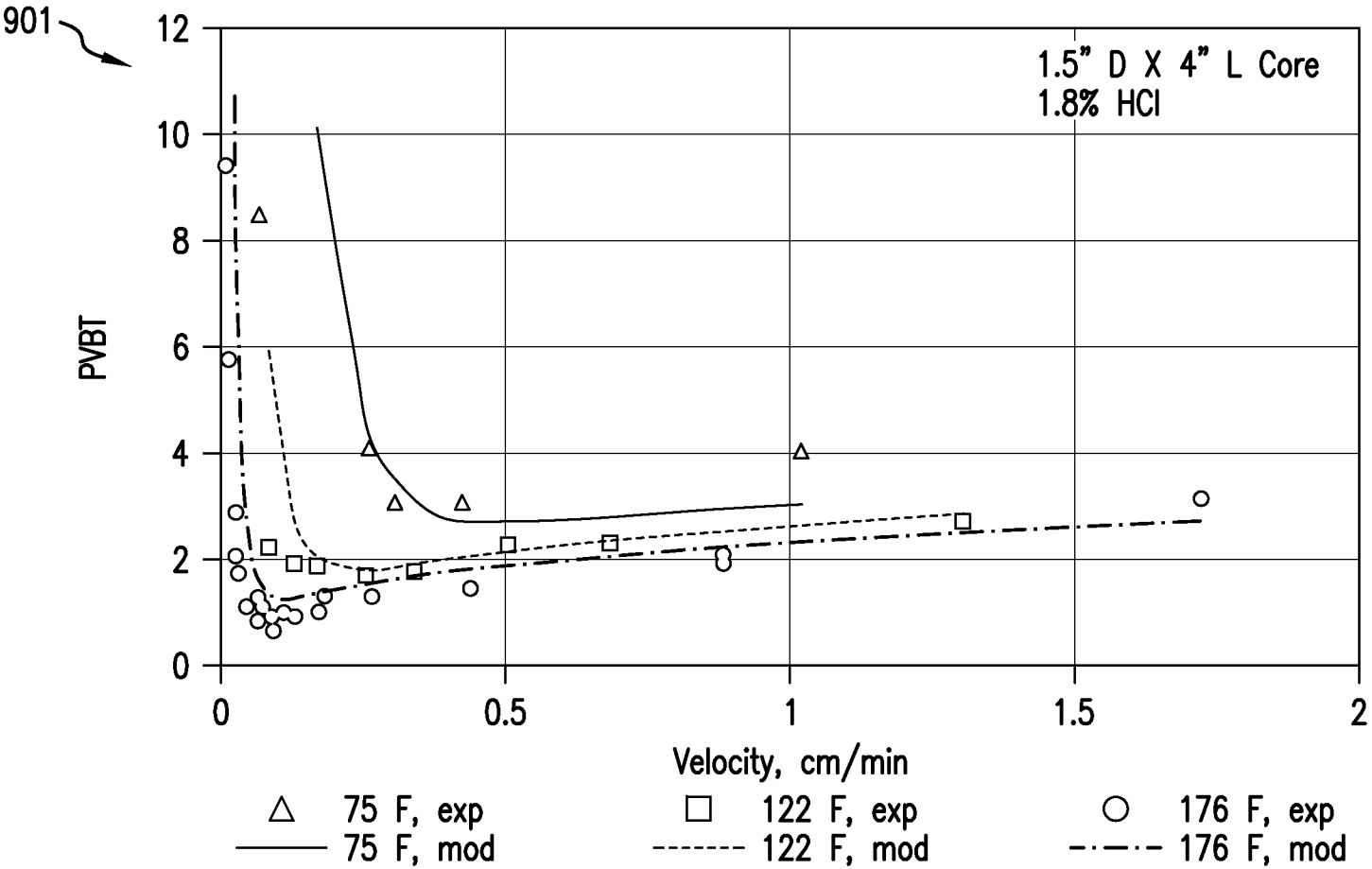

FIGS. 9A and 9B depict graphs 900, 901 respectively that show data and associated model predicts for two different acid concentrations. The graph 900 shows the effect of temperature from 70° F. to 176° F. on acid flow using 7% HCL. The graph 901 shows the effect of temperature form 75° F. to 176° F. on acid flow using 1.8% HCl. In this figure, the points (squares, triangles, and circles) represent experimental data and the lines represent wormhole velocity predictions generated by the model as described herein.

Figure 10A:
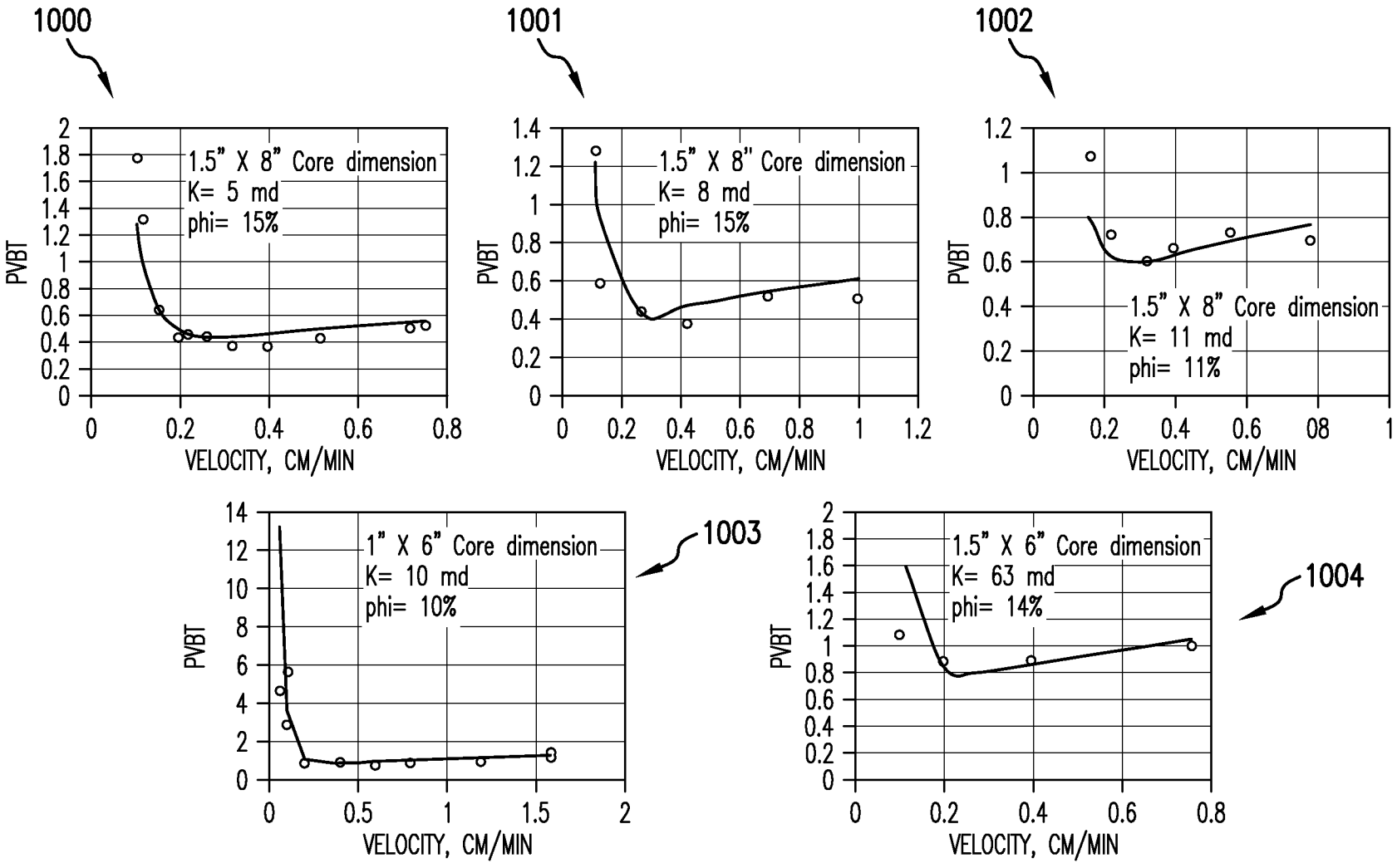
Figure 10B:
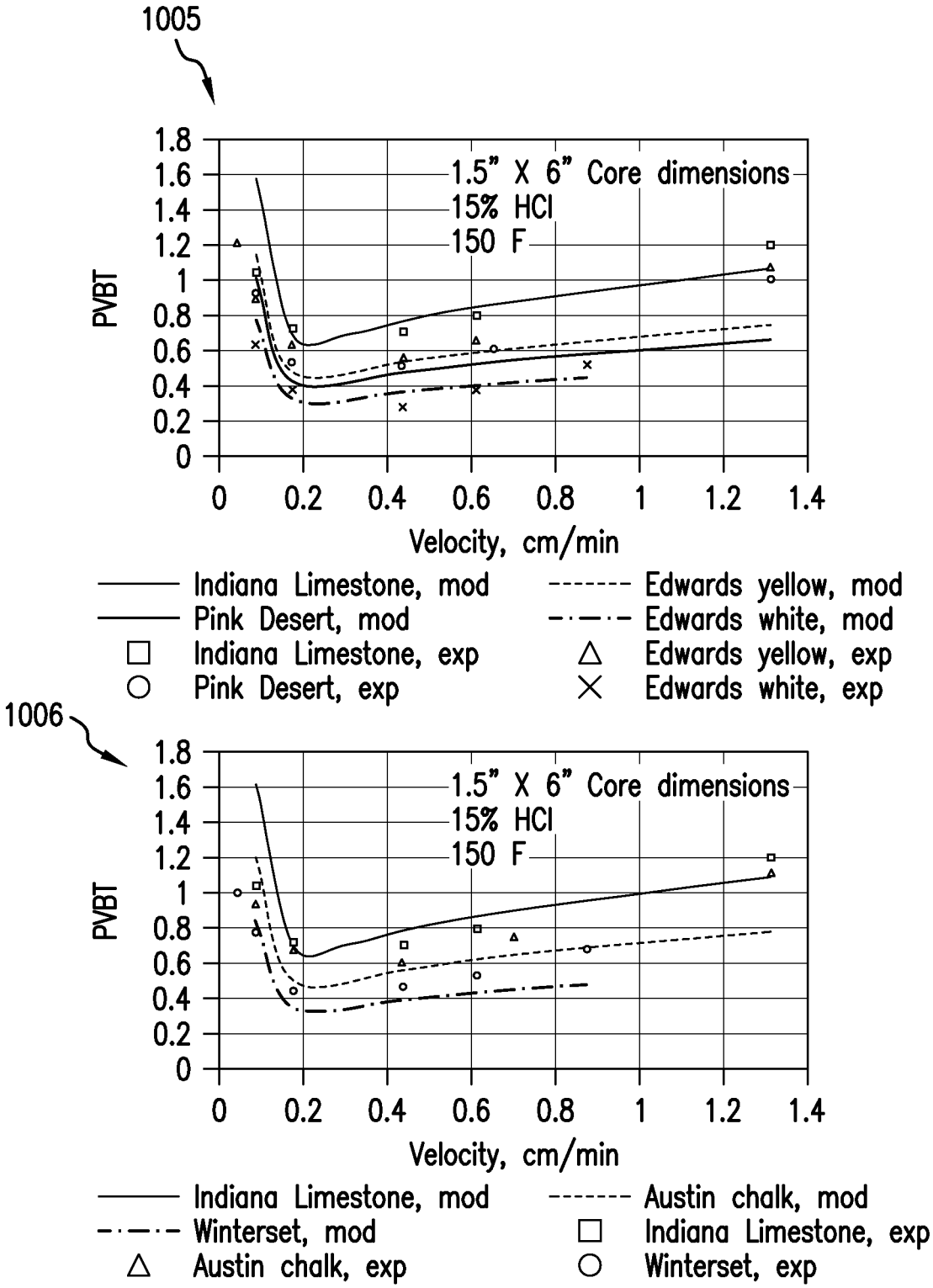

According to one or more embodiments described herein, there may be an effect of porosity and permeability on acid flow in carbonate formations. For example, it may be implied that an increase in porosity will result in an increase in PVBT curve (lower wormhole velocity). It may also be implied that changes in rock type will result in changes in both $PVBT_{opt}$ and $Vi_{opt}$. In some cases, it may be shown that using different rock types resulted in mainly a vertical shift. In some cases, changing the rock type may result in a vertical shift in the curves. Also, it may be shown that the performance of the acid can be predicted by measuring the flowing fraction. For example, this flowing fraction concept can be used to account for the effect of rock type on acid performance According to the model of the one or more embodiments described herein, the effect of rock type is a vertical shift in the acid volume to breakthrough. The porosity appears naturally in the equations described herein. An increase in porosity results in a decrease in PVBT curve. A correlation (in the expression above for $W_{eff_r}$) accounts for the permeability effect. FIGS. 10A and 10B depict graphs 1000, 1001, 1002, 1003, 1004, 1005, 1006 that show the model predictions of cores with different properties. Particularly, the graphs 1000-1004 show the effect of porosity and permeability on acid flow in Indiana limestone cores where the points (squares, triangles, and circles) represent experimental data and the lines represent wormhole velocity predictions generated by the model as described herein. The graphs 1005, 1006 show the effect of rock type on acid flow in a variety of limestone cores where the points (squares, triangles, and circles) represent experimental data and the lines represent wormhole velocity predictions generated by the model as described herein.

Figure 11:
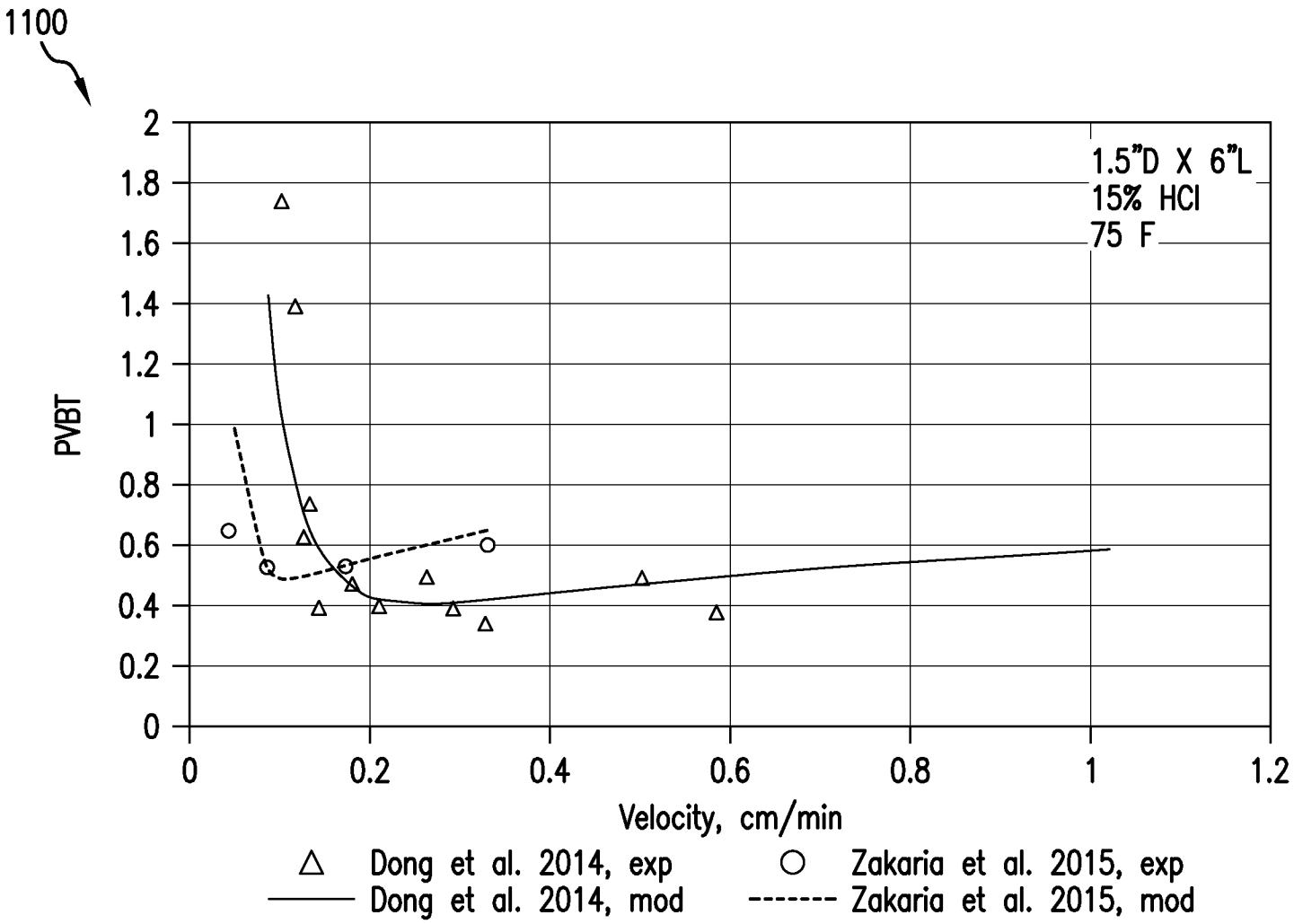

In some cases, it can be shown that type and concentration of corrosion inhibitor have an effect on the reaction rate between HCl acid and limestone. The graph 1100 of FIG. 11 shows the effect of corrosion inhibitor on acid flow in limestone cores. In this figure, the points (squares, triangles, and circles) represent experimental data and the lines represent wormhole velocity predictions generated by the model as described herein.

According to one or more embodiments described herein, the model can be tuned against HCl-dolomite. The reaction of HCl with limestone is typically mass transfer controlled. On the other hand, the HCl reaction with dolomite is controlled by the reaction rate at temperatures lower than 185 F. Like the limestone case, the diffusion coefficient for the model described herein was modified.

Figure 12:
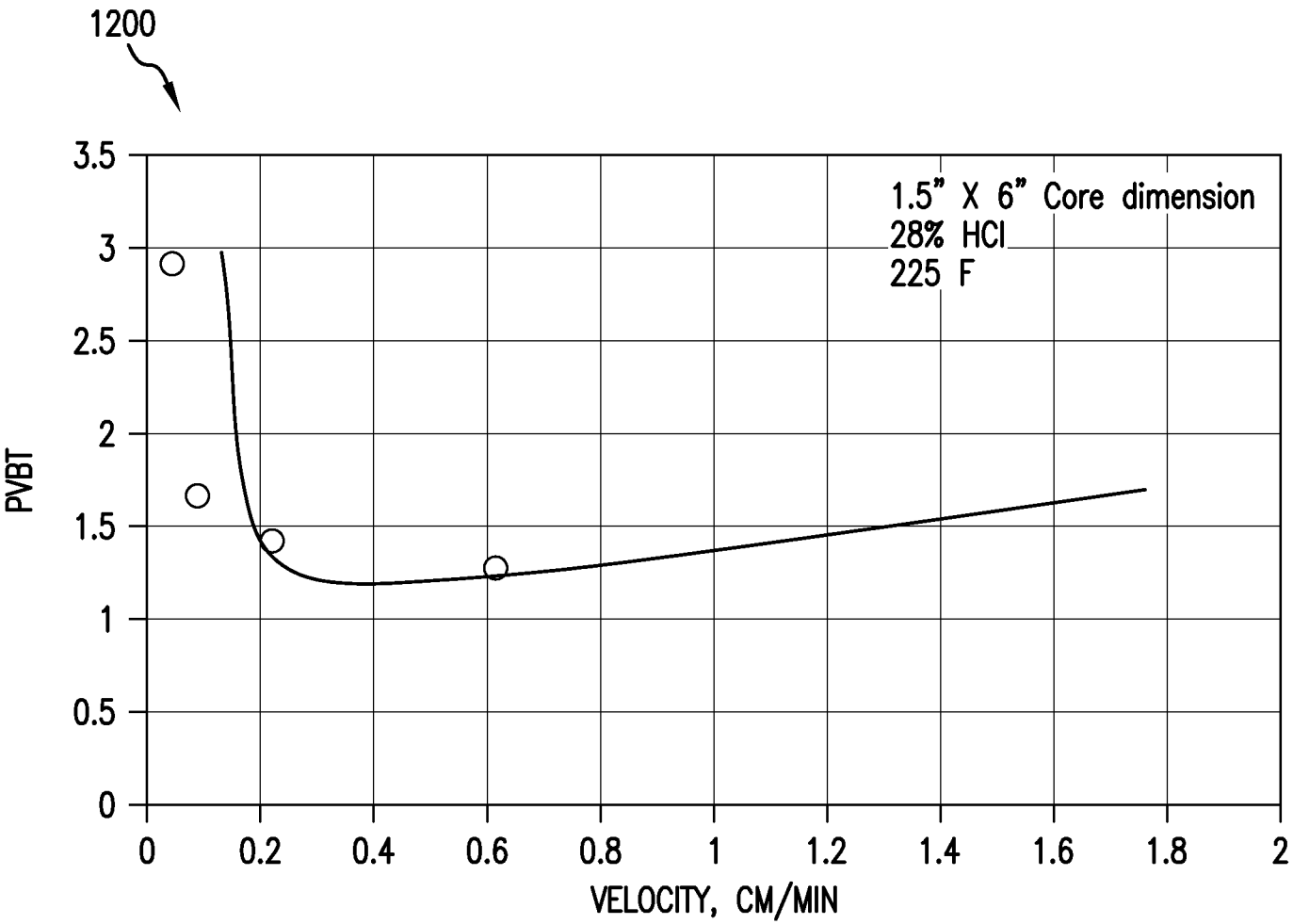

FIG. 12 depicts a graph 1200 that shows model predictions for experimental data according to one or more embodiments described herein. As an example, 28% HCl was used at 225° F. to perform experiments. Parameters can be modified/tuned to account for the specific HCl system used. The graph 1200 shows the model predictions against experimental data. In this example, modeling parameters $W_{eff_for}$ and $W_{b_for}$ were determined to be 0.32 and 5.6 respectively.

Figure 13A:
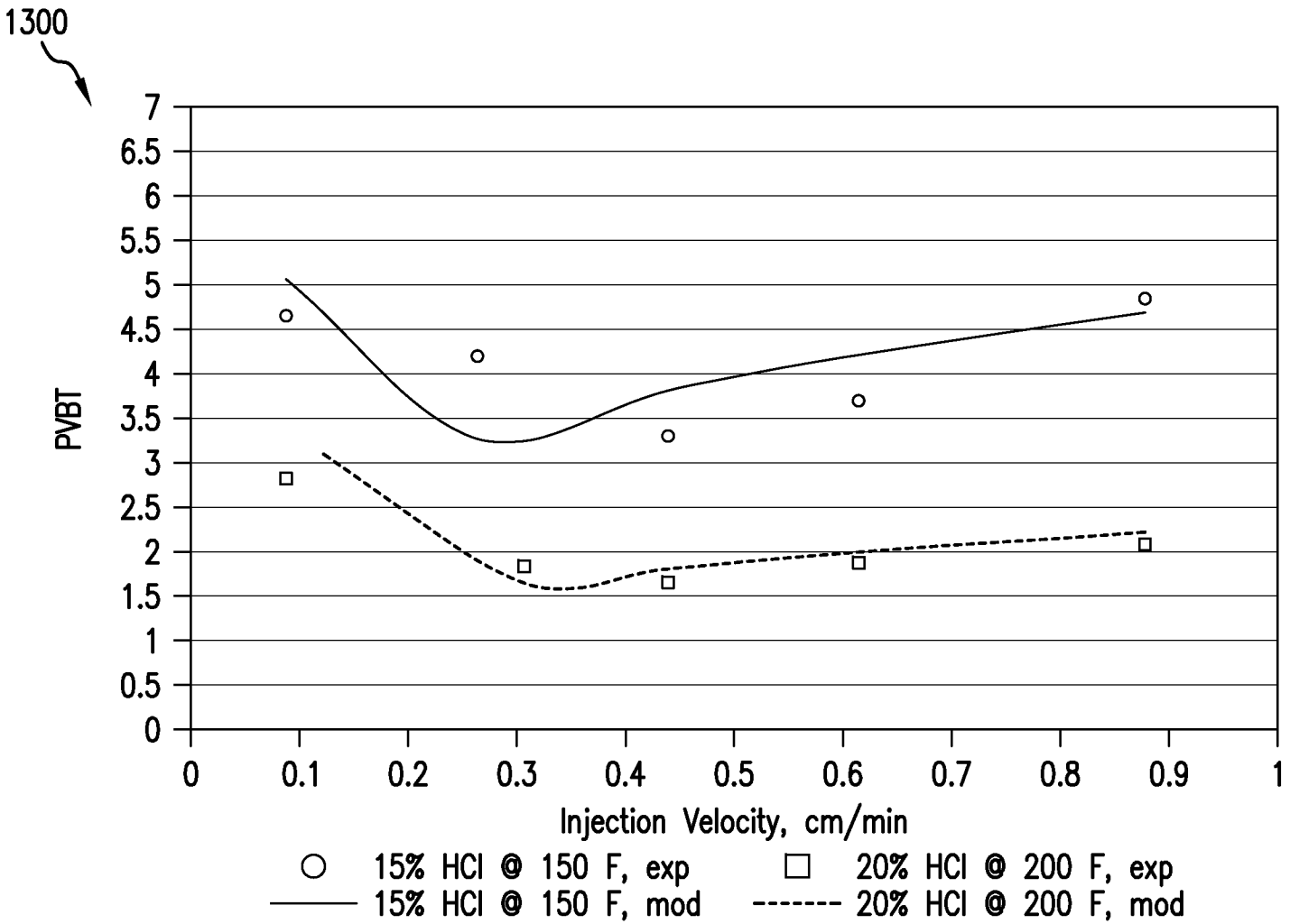
Figure 13B:
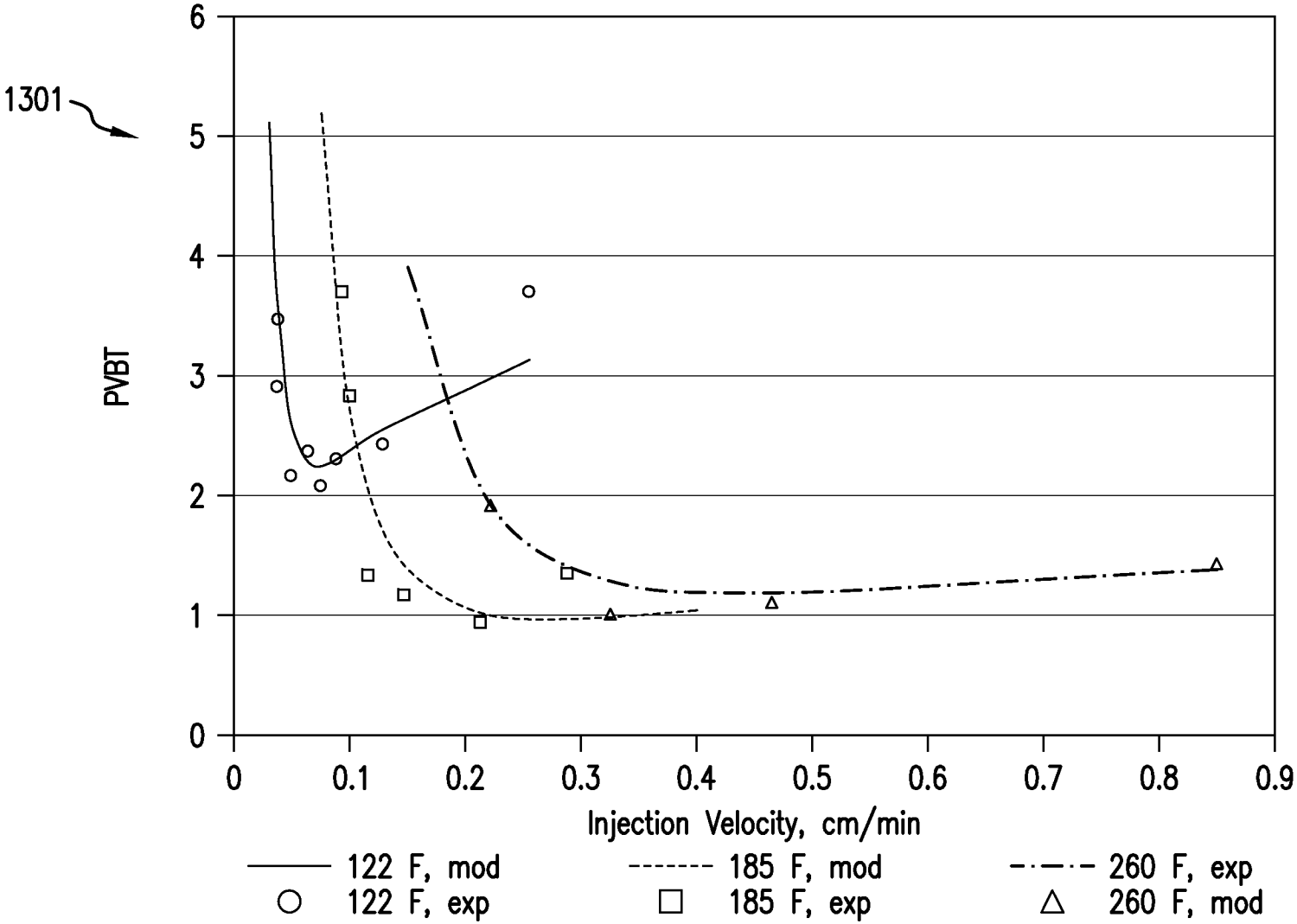
Figure 13C:
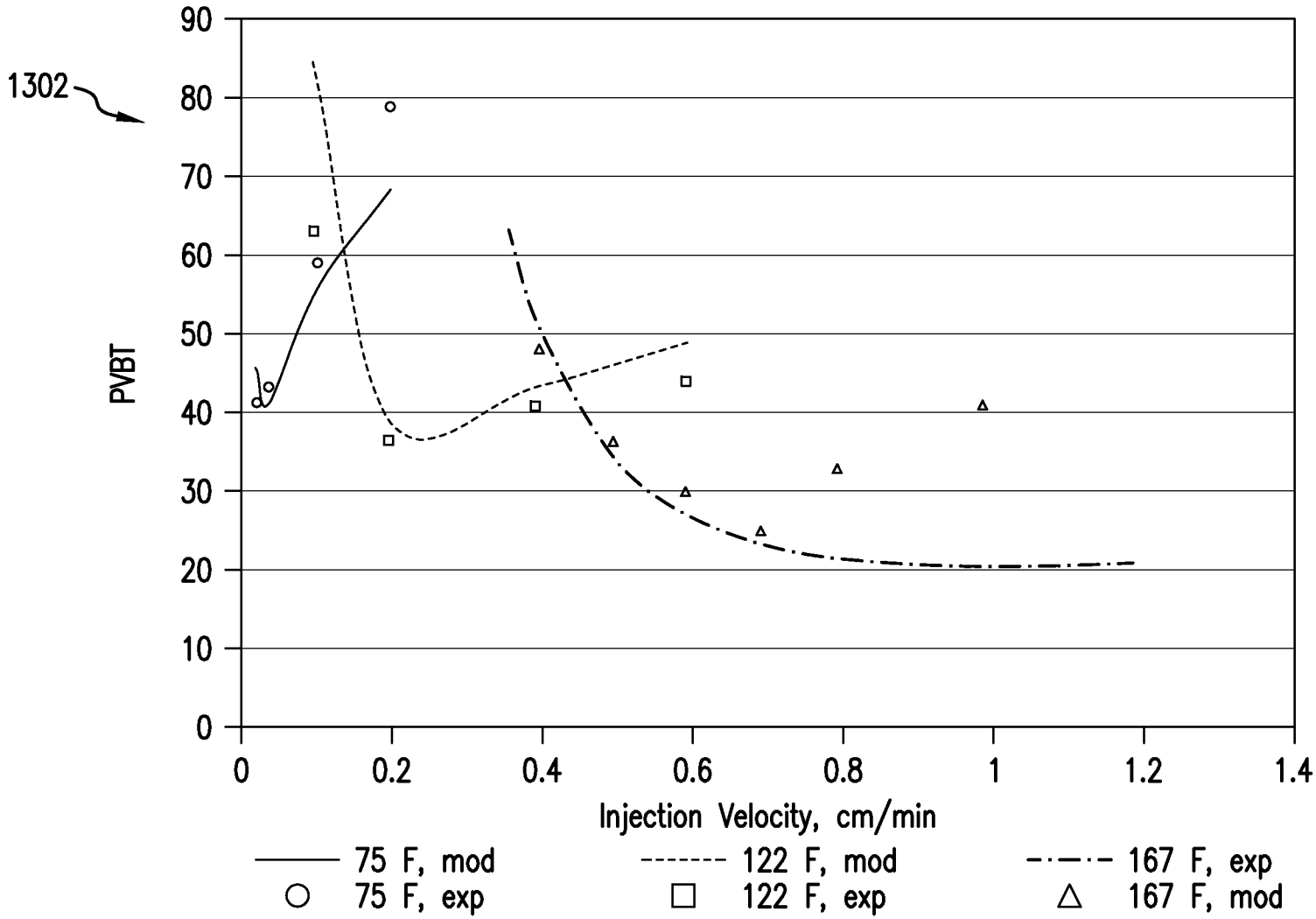

FIGS. 13A-13C depict graphs 1300-1302 that show the effect of temperature on acidizing dolomite cores. For example, FIG. 13A depicts a graph 1300 that shows the model prediction of experimental data for 15% HCl at 150 F and 20% HCl at 200 F. FIG. 13B depicts a graph 1301 that shows the effect of temperature on acidizing dolomite from 122° F. to 260° F. The experimental data shows very low PVBT values, which can be attributed to the presence of fractures or connected vugs in the cores. In examples, the model curves can be shifted vertically to match the low PVBT values. FIG. 13C depicts a graph 1302 that shows the effect of temperature on acidizing dolomite from 75° F. to 167° F. In these figures, the points (squares, triangles, and circles) represent experimental data and the lines represent injection velocity predictions generated by the model as described herein.

Figure 14A:
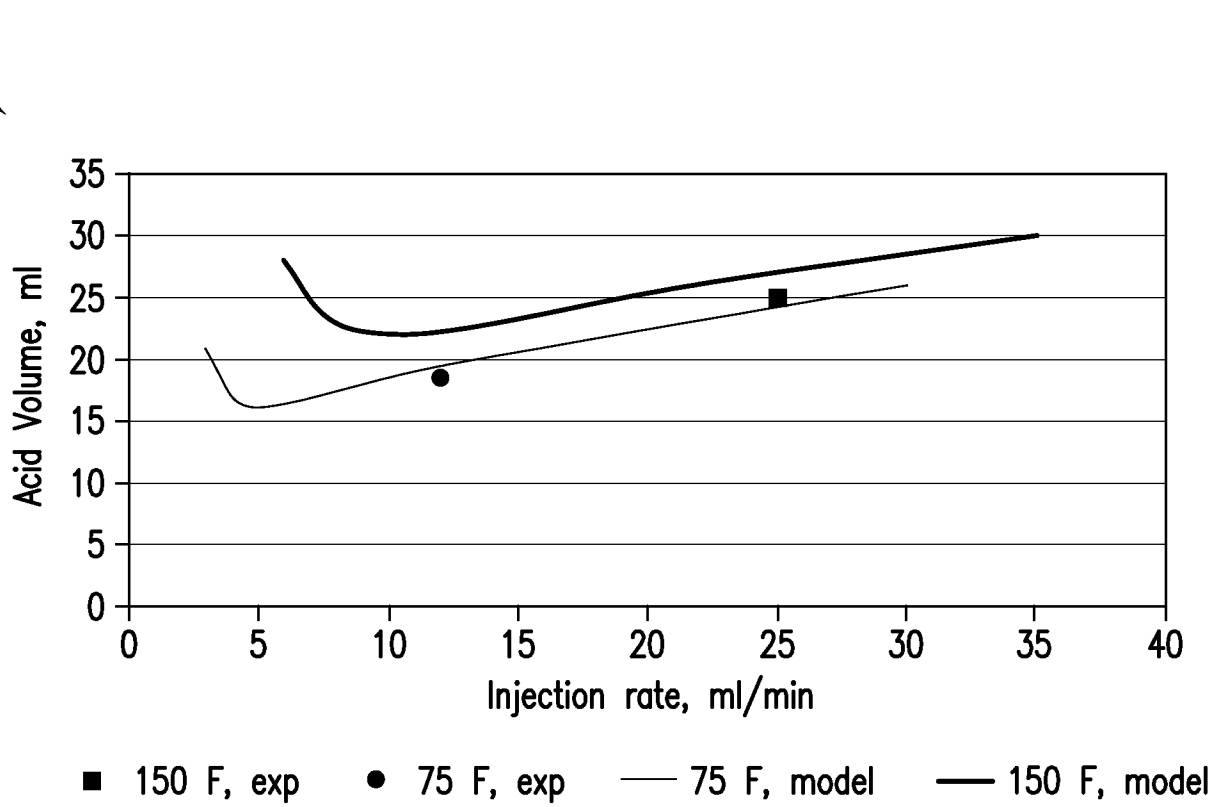
Figure 14B:
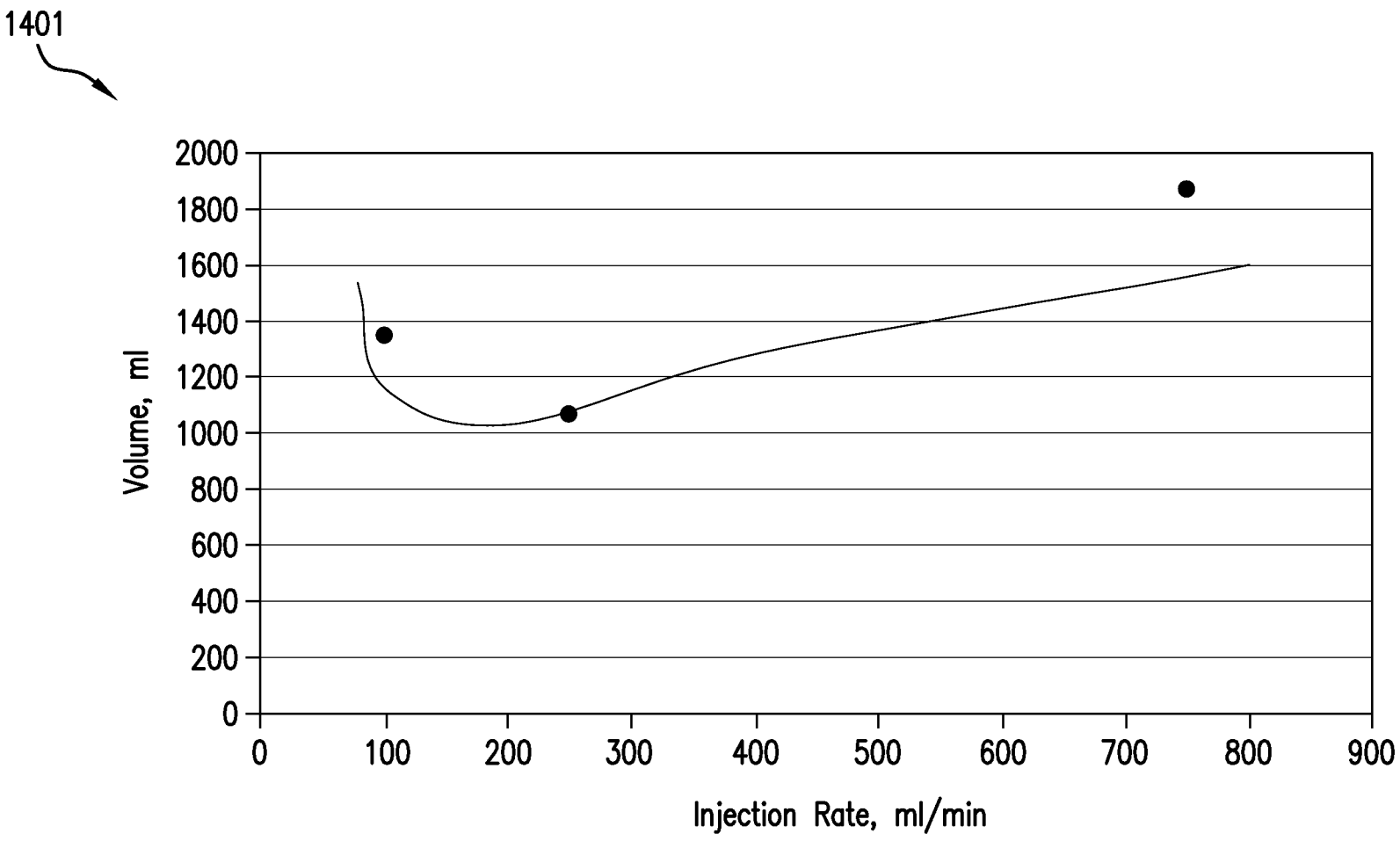

According to one or more embodiments described herein, the model can be tuned for radial flow, such as using the upscaling techniques described herein. FIG. 14A depicts a graph 1400 that shows model predictions in comparison with experiments using a block with a radius of 2.77" and height of 2.25". An 0.125" radius wellbore was drilled at the block center. FIG. 14B depicts a graph 1401 that shows model predictions in comparison with experiments at 99° F. using a block with a radius of 8" and height of 8". An 0.5625" radius wellbore was drilled at the block center. In these figures, the points (squares and circles) represent experimental data and the lines represent injection velocity predictions generated by the model as described herein.

Figure 15:
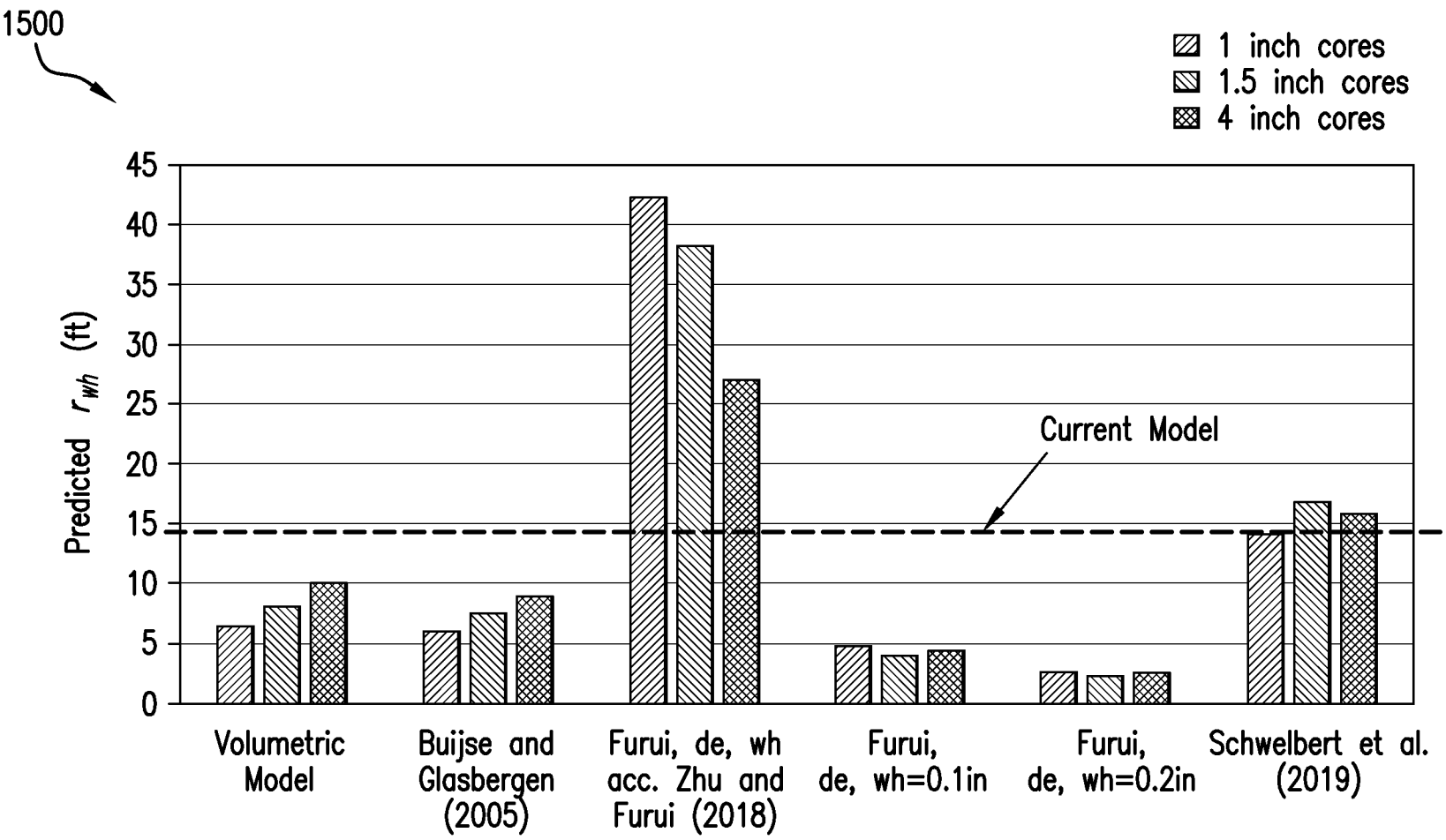
Figure 16A:
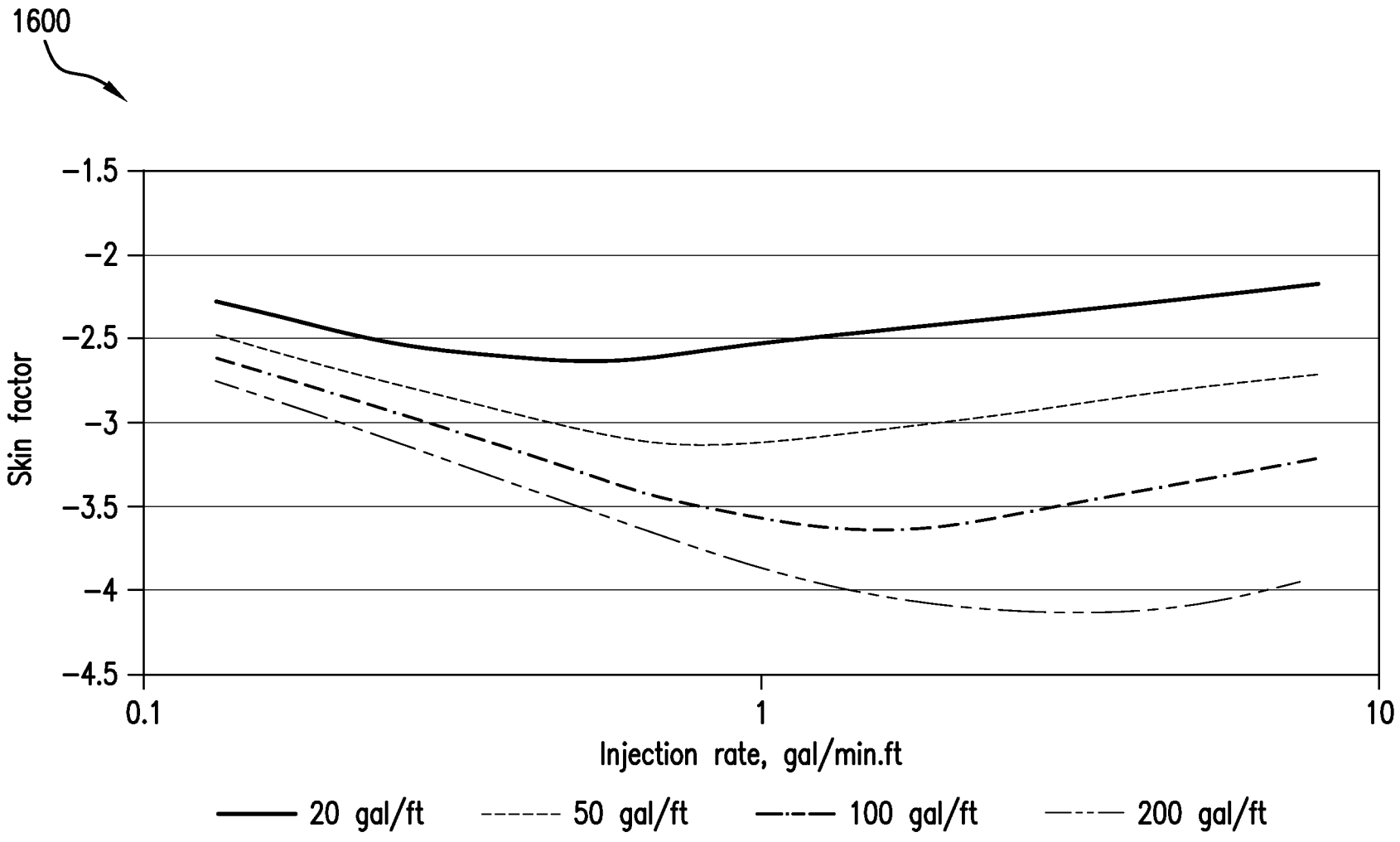
Figure 16B:
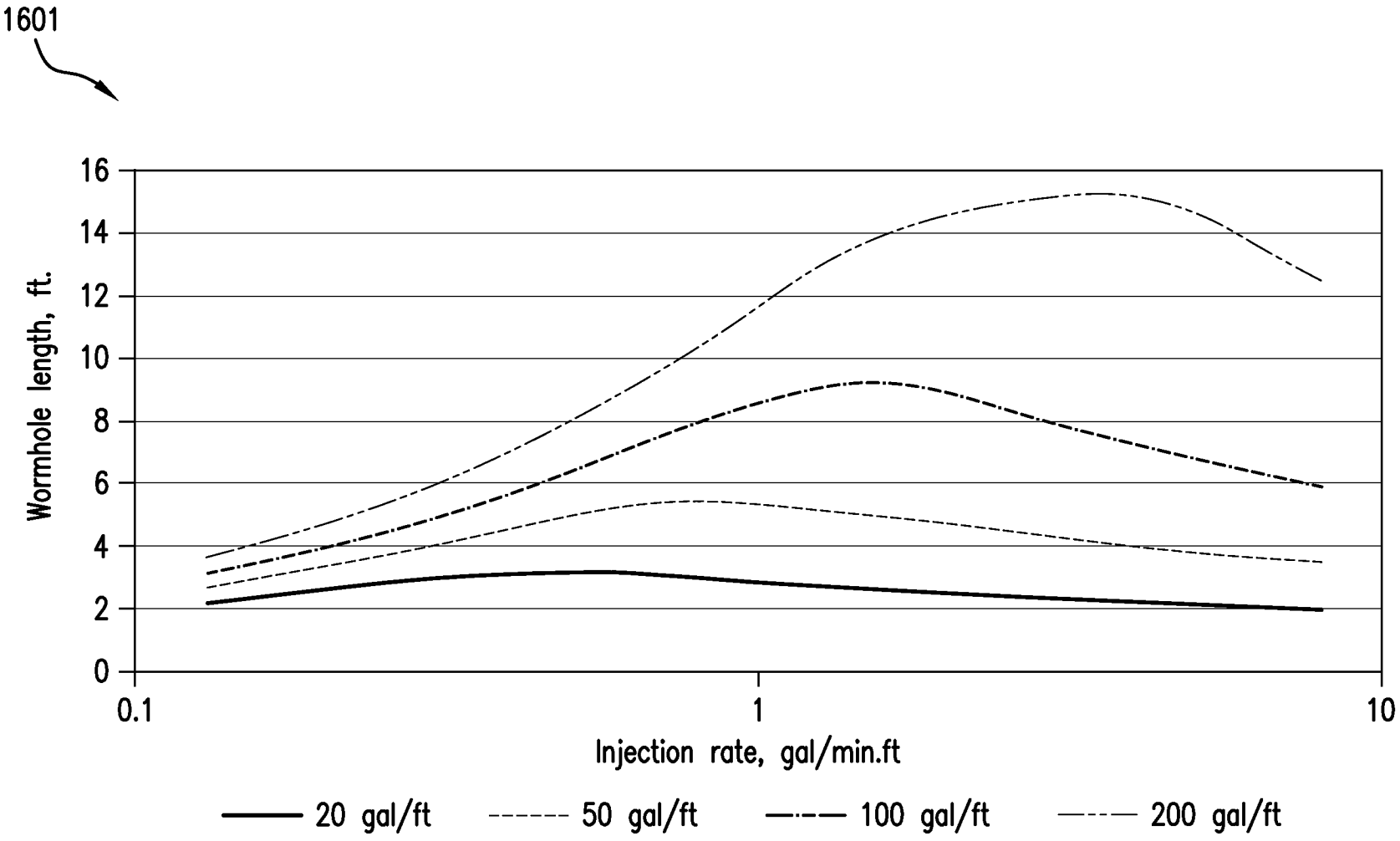

In some cases, a two-scale continuum model can be implemented to improve field predictions. For example, FIG. 15 depicts a graph 1500 that shows a comparison between conventional models (e.g., semi-empirical models) and the model according to one or more embodiments described herein for a synthetic case. As can be seen, the current model is not dependent on core size of laboratory results, and therefore is more accurate and flexible than conventional models, which results in improved hydrocarbon recovery.

According to one or more embodiments described herein, the model described herein can be applied to generate field predictions. To cases are now described to show the prediction capabilities of the model according to one or more embodiments described herein under field scale. As a first example, the model can be applied to an HCl-limestone example.

For example, the model can be applied to predict wormhole length and post-job skin for acid stimulated wells. The prediction capabilities of the model according to one or more embodiments described herein as applied to this data set are shown in the graphs 1600 and 1601 of FIGS. 16A and 16B.

The graph 1600 relates to an HCl-limestone case where the model calculations of the linear core flow experiments using 28% HCl at 225° F. (see, e.g., FIG. 12, which shows the linear experiment used to predict the radial performance). The radial performance of the acid for different acid volumes are presented in FIGS. 16A for skin and 16B for wormhole length. Particularly, the graph 1600 shows the effect of injection rate on radial skin factor at different acid volumes for limestone treated with 28% HCl at 225° F. The graph 1601 shows the effect of injection rate on wormhole length at different acid volumes for limestone treated with 28% HCl at 225° F.

Figure 17:
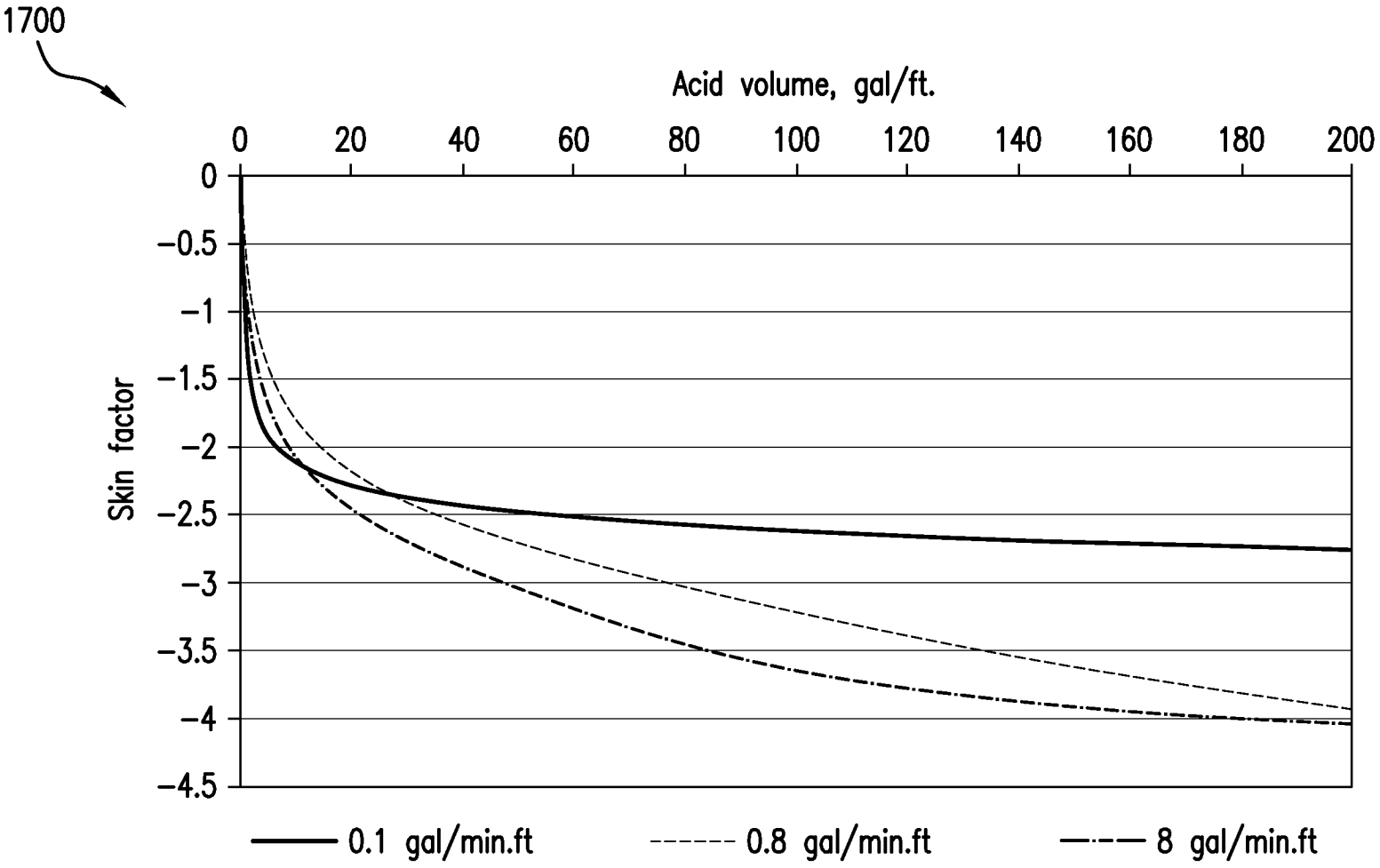
Figure 18A:
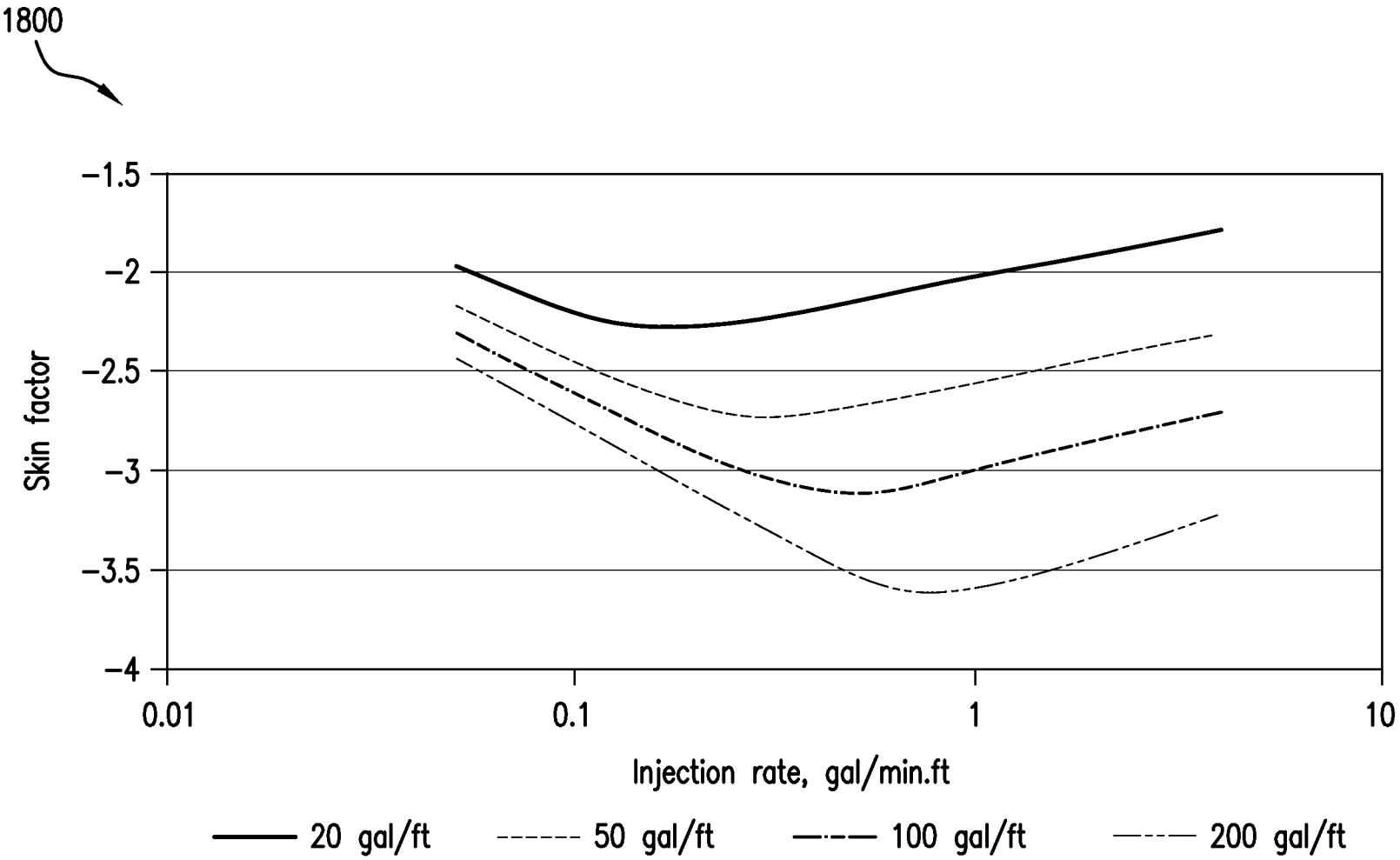
Figure 18B:
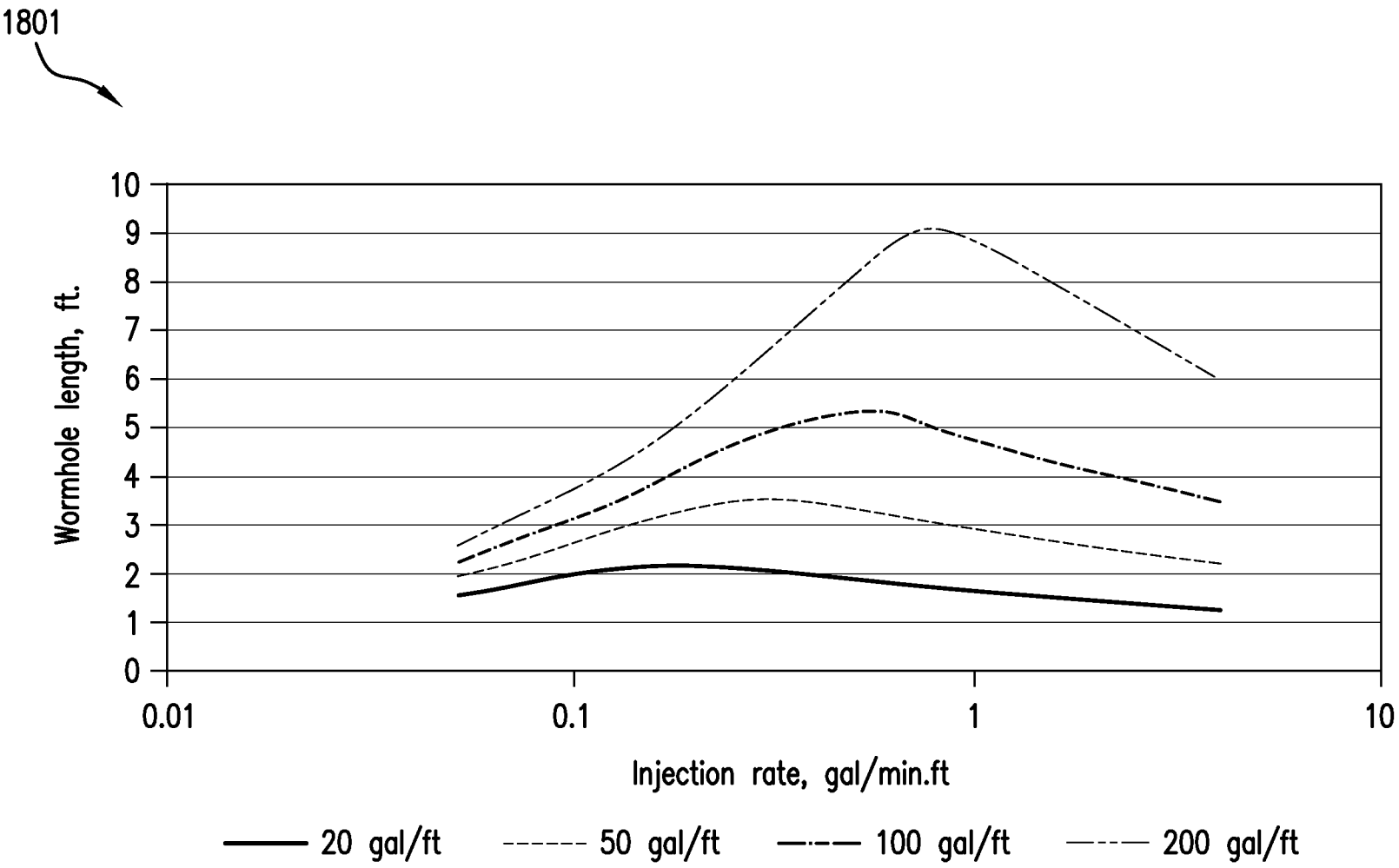

FIG. 17 depicts a graph 1700 that shows the wormhole growth as a function of acid volume at three injection rates. The graph 1700 particularly shows the skin evolution of acid volume at three injection rates of 0.1 gal/min. ft, 0.8 gal/min ft, and 8 gal/min ft for limestone treated with 28% HCl at 225° F.

As a second case, the model can be applied to an HCl-dolomite example. In such cases, the model calculations of linear core flow can be applied to experiments using 15% HCl at 150° F. (see, e.g., FIG. 13A, which shows the linear experiment used to predict the radial performance). The radial performance of the acid for different acid volumes are depicted in the graphs 1800 and 1801 of FIGS. 18A for skin and 18B for wormhole length. The graph 1800 shows the effect of injection rate on radial skin factor at different acid volumes for dolomite treated with 15% HCl at 150° F. The graph 1801 shows the effect of injection rate on wormhole length at different acid volumes for dolomite treated with 15% HCl at 150° F.

Figure 19:
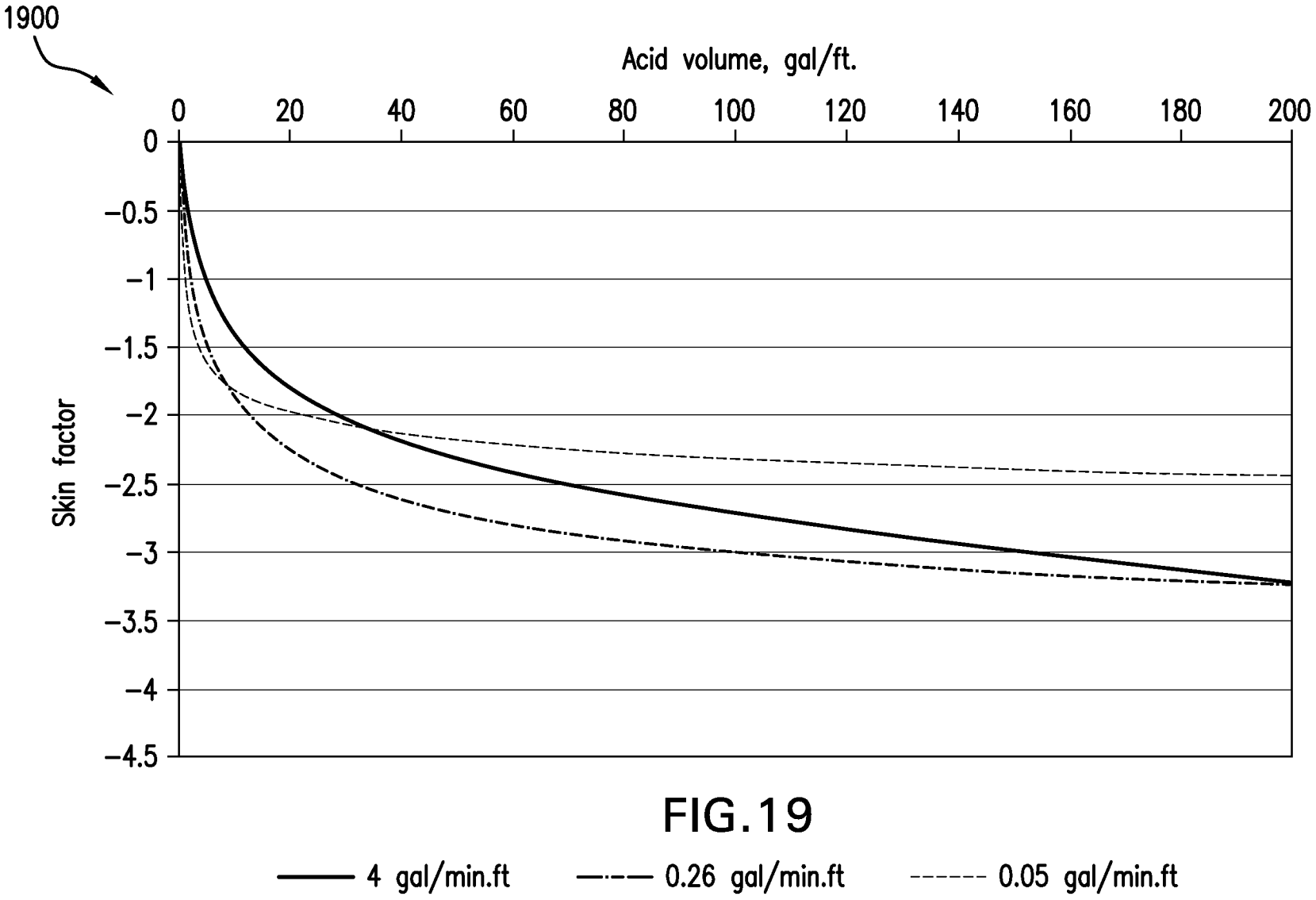

FIG. 19 depicts a graph 1900 that shows the wormhole growth as a function of acid volume at three injection rates. The graph 1900 shows skin evolution with acid volume at three injection rates for dolomite treated with 15% HCl at 150° F.

Example embodiments of the disclosure include or yield various technical features, technical effects, and/or improvements to technology. Example embodiments of the disclosure provide technical solutions for modeling acid flow in a formation. The techniques described herein represent an improvement to conventional acidizing models. Specifically, stimulation is improved by implementing the acidizing modeling approach described herein that utilizes Darcy velocity instead of interstitial velocity to eliminate the effect of porosity on wormhole velocity. Adding more, it introduces an upscaling scheme to predict acid flow under field (radial) conditions that is independent of linear core dimensions. Accordingly, stimulation decisions can be made more accurately and faster, thus improving stimulation efficiency, reducing non-production time, improving hydrocarbon recovery, and the like. This increases hydrocarbon recovery from a hydrocarbon reservoir compared to conventional techniques.

Set forth below are some embodiments of the foregoing disclosure:

Embodiment 1: A method for modeling acid flow for acid stimulation of a formation, the method comprising receiving data about the acid stimulation; modeling, by applying the data about the acid stimulation to a model, a wormhole velocity of an acid injected into the formation during the acid stimulation, wherein the wormhole velocity is a function of a Darcy velocity of the acid; determining whether the wormhole velocity satisfies a wormhole velocity threshold; responsive to determining that the wormhole velocity fails to satisfy the wormhole velocity threshold, modifying a stimulation parameter to adjust the wormhole velocity of the acid; and performing the acid stimulation based at least in part on the modified stimulation parameter.

Embodiment 2: A method according to any prior embodiment, wherein the model is expressed by the following equation:

$$V_{wh}=W_{eff}*(V)^{e1}*(1-\exp(-W_B*(V)^{e2}))^{e3}$$

where $V_{wh}$ is the wormhole velocity, $W_{eff}$ is a wormhole efficiency factor, V is the Darcy velocity of the acid, $W_b$ is a wormhole B-factor, and e1, e2, and e3 are tuning parameters.

Embodiment 3: A method according to any prior embodiment, wherein the wormhole B-factor $W_b$ is a function of an acid concentration, a diffusion coefficient, a core length, a core area, and acid additives.

Embodiment 4: A method according to any prior embodiment, wherein the wormhole efficiency factor $W_{eff}$ is a function of an acid concentration, a diffusion coefficient, a core length, a core area, and acid additives.

Embodiment 5: A method according to any prior embodiment, wherein the model is a radial model.

Embodiment 6: A method according to any prior embodiment, wherein the radial model is upscaled from a linear model.

Embodiment 7: A method according to any prior embodiment, wherein the radial model is upscaled from the linear model by applying upscaling parameters that are functions of a wellbore flow area and a wormhole length.

Embodiment 8: A method according to any prior embodiment, wherein the radial model is upscaled from the linear model further by updating the Darcy velocity of the acid as a function of radial flow area at a wormhole tip.

Embodiment 9: A method according to any prior embodiment, wherein the data about the acid stimulation comprises laboratory data and field data.

Embodiment 10: A method according to any prior embodiment, wherein receiving the data comprises collecting the laboratory data from a laboratory and collecting the field data from a wellbore operation.

Embodiment 11: A system for modeling acid flow for acid stimulation of a formation, the system comprising: a processing system for executing computer readable instructions, the computer readable instructions controlling the processing system to perform operations comprising: receiving data about the acid stimulation; modeling, by applying the data about the acid stimulation to a model, a wormhole velocity of an acid injected into the formation during the acid stimulation, wherein the model is a radial model, and wherein the radial model is upscaled from a linear model; determining whether the wormhole velocity satisfies a wormhole velocity threshold; responsive to determining that the wormhole velocity fails to satisfy the wormhole velocity threshold, modifying a stimulation parameter to adjust the wormhole velocity of the acid; and performing the acid stimulation based at least in part on the modified stimulation parameter.

Embodiment 12: A system according to any prior embodiment, wherein the model is expressed by the following equation:

$$V_{wh}=W_{eff}*(V)^{e1}*(1-\exp(-W_B*(V)^{e2}))^{e3}$$

where $V_{wh}$ is the wormhole velocity, $W_{eff}$ is a wormhole efficiency factor, V is a Darcy velocity of the acid, $W_b$ is a wormhole B-factor, and e1, e2, and e3 are tuning parameters.

Embodiment 13: A system according to any prior embodiment, wherein the wormhole B-factor $W_b$ is a function of an acid concentration, a diffusion coefficient, a core length, a core area, and an acid additive.

Embodiment 14: A system according to any prior embodiment, wherein the wormhole efficiency factor $W_{eff}$ is a function of an acid concentration, a diffusion coefficient, a core length, a core area, and an acid additive.

Embodiment 15: A system according to any prior embodiment, wherein the wormhole velocity is a function of a Darcy velocity of the acid.

Embodiment 16: A system according to any prior embodiment, wherein the radial model is upscaled from the linear model by applying upscaling parameters that are functions of a wellbore flow area and a wormhole length.

Embodiment 17: A system according to any prior embodiment, wherein the radial model is upscaled from the linear model further by updating the velocity of the acid as a function of radial flow area at a wormhole tip.

Embodiment 18: A system according to any prior embodiment, wherein the data about the acid stimulation comprises laboratory data and field data.

Embodiment 19: A system according to any prior embodiment, wherein receiving the data comprises collecting the laboratory data from a laboratory and collecting the field data from a wellbore operation.

The use of the terms "a" and "an" and "the" and similar referents in the context of describing the present disclosure (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure can be used in a variety of well operations. These operations can involve using one or more treatment agents to treat a formation, the fluids resident in a formation, a wellbore, and/or equipment in the wellbore, such as production tubing. The treatment agents can be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the present disclosure has been described with reference to an embodiment or embodiments, it will be understood by those skilled in the art that various changes can be made and equivalents can be substituted for elements thereof without departing from the scope of the present disclosure. In addition, many modifications can be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims. Also, in the drawings and the description, there have been disclosed embodiments of the present disclosure and, although specific terms can have been employed, they are unless otherwise stated used in a generic and descriptive sense only and not for purposes of limitation, the scope of the present disclosure therefore not being so limited.

What is claimed is:

1. A method for modeling an acid flow for an acid stimulation of a formation, the method comprising:

receiving data about the acid stimulation;

modeling, by applying the data about the acid stimulation to a model, a wormhole velocity of an acid injected into the formation during the acid stimulation, wherein the wormhole velocity is a function at least of a Darcy velocity of the acid, a wormhole efficiency factor, and an exponential wormhole B-factor;

determining whether the wormhole velocity satisfies a wormhole velocity threshold;

responsive to determining that the wormhole velocity fails to satisfy the wormhole velocity threshold, modifying a stimulation parameter to adjust the wormhole velocity of the acid; and performing the acid stimulation based at least in part on the modified stimulation parameter.

2. The method of claim 1, wherein the model is expressed by the following equation:

$$V_{wh}=W_{eff}*(V)^{e1}*(1-\exp(-W_E*(V)^{e2}))^{e3}$$

where $V_{wh}$ is the wormhole velocity, $W_{eff}$ is the wormhole efficiency factor, V is the Darcy velocity of the acid, $W_b$ is the exponential wormhole B-factor, and e1, e2, and e3 are tuning parameters.

3. The method of claim 2, wherein the exponential wormhole B-factor $W_b$ is a function of an acid concentration, a diffusion coefficient, a core length, a core area, and acid additives.

4. The method of claim 2, wherein the wormhole efficiency factor $W_{eff}$ is a function of an acid concentration, a diffusion coefficient, a core length, a core area, and acid additives.

5. The method of claim 1, wherein the model is a radial model.

6. The method of claim 5, wherein the radial model is upscaled from a linear model.

7. The method of claim 6, wherein the radial model is upscaled from the linear model by applying upscaling parameters that are functions of a wellbore flow area and a wormhole length.

8. The method of claim 7, wherein the radial model is upscaled from the linear model further by updating the Darcy velocity of the acid as a function of radial flow area at a wormhole tip.

9. The method of claim 1, wherein the data about the acid stimulation comprises laboratory data and field data.

10. The method of claim 9, wherein receiving the data comprises collecting the laboratory data from a laboratory and collecting the field data from a wellbore operation.

11. A system for modeling an acid flow for an acid stimulation of a formation, the system comprising:

a processing system for executing computer readable instructions, the computer readable instructions controlling the processing system to perform operations comprising:

receiving data about the acid stimulation;

modeling, by applying the data about the acid stimulation to a model, a wormhole velocity of an acid injected into the formation during the acid stimulation, wherein the wormhole velocity is a function at least of a Darcy velocity of the acid, a wormhole efficiency factor, and an exponential wormhole B-factor, wherein the model is a radial model, and wherein the radial model is upscaled from a linear model;

determining whether the wormhole velocity satisfies a wormhole velocity threshold;

responsive to determining that the wormhole velocity fails to satisfy the wormhole velocity threshold, modifying a stimulation parameter to adjust the wormhole velocity of the acid; and performing the acid stimulation based at least in part on the modified stimulation parameter.

12. The system of claim 11, wherein the model is expressed by the following equation:

$$V_{wh}=W_{eff}*(V)^{e1}*(1-\exp(-W_B*(V)^{e2}))^{e3}$$

where $V_{wh}$ is the wormhole velocity, $W_{eff}$ is the wormhole efficiency factor, V is the Darcy velocity of the acid, $W_b$ is the exponential wormhole B-factor, and e1, e2, and e3 are tuning parameters.

13. The system of claim 12, wherein the exponential wormhole B-factor $W_b$ is a function of an acid concentration, a diffusion coefficient, a core length, a core area, and an acid additive.

14. The system of claim 12, wherein the wormhole efficiency factor $W_{eff}$ is a function of an acid concentration, a diffusion coefficient, a core length, a core area, and an acid additive.

15. The system of claim 11, wherein the wormhole velocity is a function of a Darcy velocity of the acid.

16. The system of claim 11, wherein the radial model is upscaled from the linear model by applying upscaling parameters that are functions of a wellbore flow area and a wormhole length.

17. The system of claim 16, wherein the radial model is upscaled from the linear model further by updating the velocity of the acid as a function of radial flow area at a wormhole tip.

18. The system of claim 11, wherein the data about the acid stimulation comprises laboratory data and field data.

19. The system of claim 18, wherein receiving the data comprises collecting the laboratory data from a laboratory and collecting the field data from a wellbore operation.

* * * * *